US008317466B2

(12) United States Patent
Sakamoto et al.

(10) Patent No.: US 8,317,466 B2
(45) Date of Patent: Nov. 27, 2012

(54) BLADE STRUCTURE OF GAS TURBINE

(75) Inventors: Yasuro Sakamoto, Hyogo (JP); Eisaku Ito, Hyogo (JP); Susumu Wakazono, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 486 days.

(21) Appl. No.: 12/518,445

(22) PCT Filed: May 10, 2007

(86) PCT No.: PCT/JP2007/059682
§ 371 (c)(1),
(2), (4) Date: Jun. 10, 2009

(87) PCT Pub. No.: WO2008/084563
PCT Pub. Date: Jul. 17, 2008

(65) Prior Publication Data

US 2010/0047065 A1 Feb. 25, 2010

(30) Foreign Application Priority Data

Jan. 12, 2007 (JP) ..... 2007-005042

(51) Int. Cl.
*F01D 5/12* (2006.01)

(52) U.S. Cl. ..... 415/193; 415/199.5; 415/208.2

(58) Field of Classification Search ..... 415/191, 415/192, 193, 199.5, 208.2, 211.2
See application file for complete search history.

(56) References Cited

U.S. PATENT DOCUMENTS 3,202,399 A * 8/1965 Rudolf Bar ..... 415/87
6,017,186 A * 1/2000 Hoeger et al. ..... 415/181
6,471,474 B1 10/2002 Mielke et al.

(Continued)

FOREIGN PATENT DOCUMENTS

CH 586841 A5 * 4/1977

(Continued)

OTHER PUBLICATIONS

International Search Report of PCT/JP2007/059682, Mailing Date of Jul. 24, 2007.

(Continued)

*Primary Examiner* — Edward Look
*Assistant Examiner* — Christopher R Legendre
(74) *Attorney, Agent, or Firm* — Westerman, Hattori, Daniels & Adrian, LLP

(57) ABSTRACT

To reduce secondary flow loss and to improved turbine efficiency, a section located radially outward of a border section 28 of a stationary blade 21 is bent in the rotational direction of a rotor. Thus, even if combustion gas leaks from a tip clearance between an end wall of a casing and a tip portion of a rotor blade, and a stagnation line 35 near a tip portion 22 is situated in the side of a back surface 24, because a section located radially outward of the border section 28 is bent in the rotational direction of the rotor, the stagnation line 35 is also situated toward the rotational direction of the rotor. Therefore, the stagnation lines 35 formed at various heights in the heightwise direction of the stationary blade 21 are generally aligned in the rotational direction of the rotor. Thus, fluctuation of pressure distribution in the heightwise direction of the stationary blade 21, of the combustion gas flowing into the stationary blade 21 can be reduced. As a result, secondary flow loss can be reduced and turbine efficiency can be improved.

2 Claims, 20 Drawing Sheets

U.S. PATENT DOCUMENTS

| | | | | |
|---|---|---|---|---|
| 6,755,612 | B2 | 6/2004 | Shahpar et al. | |
| 7,354,243 | B2 * | 4/2008 | Harvey | 415/191 |
| 2003/0170124 | A1 * | 9/2003 | Staubach et al. | 416/193 A |
| 2004/0091353 | A1 * | 5/2004 | Shahpar et al. | 415/192 |
| 2007/0258810 | A1 * | 11/2007 | Aotsuka et al. | 415/206 |
| 2010/0047065 | A1 * | 2/2010 | Sakamoto et al. | 415/199.5 |

FOREIGN PATENT DOCUMENTS

| | | | |
|---|---|---|---|
| EP | 1199439 | A2 | 4/2002 |
| JP | 57-18405 | A | 1/1982 |
| JP | 62-114105 | U | 7/1987 |
| JP | 10-002202 | A | 1/1998 |
| JP | 10-018804 | A | 1/1998 |
| JP | 10-077801 | A | 3/1998 |
| JP | 2000-230403 | A | 8/2000 |
| JP | 2001-164902 | A | 6/2001 |
| JP | 2002-161702 | A | 6/2002 |
| JP | 2002-517666 | A | 6/2002 |
| JP | 2002-213206 | A | 7/2002 |
| JP | 2006-207556 | A | 8/2006 |
| WO | 2006-033407 | A1 | 3/2006 |
| WO | WO 2006033407 | A1 * | 3/2006 |

OTHER PUBLICATIONS

Japanese Office Action dated Apr. 19, 2011, issued in corresponding Japanese Patent Application No. 2007-005042.

Decision of a Patent Grant dated Sep. 6, 2011, issued in corresponding Japanese Patent Application No. 2007-005042.

Notice of Allowance dated Jun. 13, 2012, issued in corresponding Korean Patent Application No. 10-2009-7014502 (partial translation) (3 pages).

* cited by examiner

BLADE STRUCTURE OF GAS TURBINE

TECHNICAL FIELD

The present invention relates to a blade structure of a gas turbine. More particularly, the invention relates to a blade structure of a gas turbine having a gap between an outer edge portion of a rotor blade thereof and a casing thereof.

BACKGROUND ART

FIG. 17 is a schematic for explaining a rotor blade and a stationary blade showing a blade structure of a conventional gas turbine. FIG. 18 is a sectional view cut along the line D-D of FIG. 17. FIG. 19 is a perspective view of the stationary blade and the rotor blade shown in FIG. 18. A blade structure of a conventional gas turbine includes a plurality of stages of stationary blades 81 arranged annularly on a casing 61 and a plurality of stages of rotor blades 71 arranged annularly on a rotor 65 that is rotatable about a rotating axis 66. The stationary blades 81 and the rotor blades 71 are arranged alternately in the direction of the rotating axis 66. In some gas turbines having such a blade structure, a shroud (not shown) is not provided on each rotor blade 71 on a side of a tip portion 72 located on a side of an outer edge portion of the rotor blade 71 in the radial direction of the rotor 65. More specifically, shrouds are typically not provided particularly on high-pressure stages of the rotor blades 71. In such cases, a gap is provided between the tip portion 72 of each rotor blade 71 and an end wall 62 of the casing 61. That is, a tip clearance 90 is provided therebetween. Thus, when the tip clearance 90 is provided therebetween, sometimes combustion gas leaks from the tip clearance 90 and flows downstream when the rotor 65 rotates. As a result, the pressure loss of the gas turbine may increase.

When the rotor 65 rotates, a main flow 92 of the combustion gas flows along the shape of a back surface 74 and a ventral surface 75 of each rotor blade 71, and flows into the stationary blade 81 located downstream of the rotor blade 71. Thus, when combustion gas flows into each stationary blade 81, the combustion gas flows generally along the shape of a back surface 84 and a ventral surface 85 near a leading edge 86 of the stationary blade 81. On the other hand, a leakage flow 93 of combustion gas that flows leaking from the tip clearance 90 flows into the stationary blade 81 at an angle different from the angle at which the main flow 92 of combustion gas flows thereinto.

Thus, in the combustion gas flowing along each rotor blade 71, there is a difference between a pressure on the side of the back surface 74 thereof and a pressure on the side of the ventral surface 75 thereof, and the pressure on the side of the ventral surface 75 is higher than the pressure on the side of the back surface 74. Therefore, the combustion gas flowing on the side of the ventral surface 75 leaks from the tip clearance 90 and flows into the side of the back surface 74 as the leakage flow 93. The leakage flow 93 flows so that the leakage flow 93 and the main flow 92 of combustion gas cross each other. Thus, when the leakage flow 93 flows into the stationary blade 81, the leakage flow 93 flows thereinto at an angle different from the angle at which the main flow 92 of combustion gas flows thereinto. Because the leakage flow 93 does not flow in the direction along the shape of the stationary blade 81, the pressure loss increases.

Therefore, some blade structures of conventional gas turbines are designed to reduce the pressure loss due to combustion gas leaking from the tip clearance 90. For example, in a blade structure of a gas turbine disclosed in Japanese Patent Application Laid-open No. 2002-213206, each stationary blade is so designed that a leading edge including an angle, that is, an angle between the back surface and the ventral surface near the leading edge of the stationary blade at the tip portion, is different from a leading edge including an angle at any position other than the tip portion. More specifically, the leading edge including an angle at the tip portion is larger than a leading edge including an angle at any position other than the tip portion. Thus, relationship between an incidence angle, that is, an angle between the direction in which the stationary blade is formed and the direction in which the combustion gas leaking from the tip clearance flows, and the pressure loss fluctuates less. Therefore, the pressure loss due to combustion gas leaking from the tip clearance of the rotor blade can be reduced.

DISCLOSURE OF INVENTION

Problem to be Solved by the Invention

FIGS. 20 and 21 are schematics for explaining gas flowing into the stationary blade shown in FIG. 17. When combustion gas flows from the rotor blade 71 to the stationary blade 81, the combustion gas hits the stationary blade 81 near the leading edge 86 of the stationary blade 81, and then, branches into the side of the back surface 84 of the stationary blade 81 and into the side of the ventral surface 85 thereof. Therefore, a stagnation line 96 that is a boundary between the combustion gas flowing into the side of the back surface 84 and the combustion gas flowing into the side of the ventral surface 85 is formed near the leading edge 86 of the stationary blade 81. Thus, the combustion gas flowing from the rotor blade 71 to the stationary blade 81 flows so that the combustion gas branches at the stagnation line 96 as a boundary into the side of the back surface 84 and into the side of the ventral surface 85. Therefore, the position of the stagnation line 96 near the leading edge 86 of the stationary blade 81 is preferably constant regardless of position in a heightwise direction of the stationary blade 81. If combustion gas leaks from the tip clearance 90 of the rotor blade 71 and the leakage flow 93 thus occurs, however, the position of the stagnation line 96 fluctuates.

More specifically, if the leakage flow 93 from the tip clearance 90 flows into the stationary blade 81, combustion gas due to the leakage flow 93 flows into the stationary blade 81 from a position closer to the side of the back surface 84 near the leading edge 86 of the stationary blade 81. Therefore, the stagnation line 96 is positioned on the side of the back surface 84 near a tip portion 82 of the stationary blade 81. Thus, the stagnation line 96 formed on the stationary blade 81 is shifted toward the side of the back surface 84 only near the tip portion 82. Therefore, pressure distribution of the combustion gas flowing along the stationary blade 81 fluctuates with respect to a position in the heightwise direction of the stationary blade 81. As shown by constant pressure lines 99 in FIGS. 20 and 21, pressure applied near the leading edge 86 of the stationary blade 81 is distorted toward the direction of the back surface 84 near the tip portion 82. Consequently, on the side of the back surface 84 of the stationary blade 81, a flow is induced that flows from the side of the tip portion 82 to the side of an inner edge portion 83 in the heightwise direction of the stationary blade 81. A flow direction 98 of the combustion gas flowing along the side of the back surface 84 is from the side of the leading edge 86 of the stationary blade 81 to a trailing edge 87 thereof and from the side of the tip portion 82 to the inner edge portion 83. Thus, a strong secondary flow is generated. Consequently, secondary flow loss may occur, and turbine efficiency may be decreased.

In view of the foregoing, an object of the invention is to provide a blade structure of a gas turbine that can reduce secondary flow loss and can enhance turbine efficiency.

Means for Solving Problem

According to an aspect of the present invention, a blade structure of a gas turbine includes stationary blades that are arranged annularly in a casing and rotor blades that are arranged annularly on a rotor that is rotatable about a rotating axis. The stationary blades and the rotor blades are alternately provided to form a plurality of stages in a rotating axis direction, and a gap is provided between outer edge portions of the rotor blades and the casing. Assuming that a height of each of the stationary blades in a radial direction of the rotor is 100%, each of the stationary blades located downstream of the rotor blade between which and the casing the gap is provided includes a border section at a position of about 80% of the height of the stationary blade outward in the radial direction from an inner edge portion of the stationary blade, and at least a part of a section located outward of the border section in the radial direction is bent in a rotational direction of the rotor.

According to the invention, at least a part of the section located outward of the border section of the stationary blade is bent in the rotational direction of the rotor. Therefore, stagnation lines can be generally aligned in the rotational direction of the rotor. If combustion gas leaks from the gap between the casing and a rotor blade, the combustion gas flows near the leading edge of the stationary blade located downstream of the rotor blade and flows into the side of the back surface near the outer edge portion. Therefore, the stagnation line near the leading edge has tendency to be situated closer to the side of the back surface than the stagnation line in the other section. On the other hand, a part of the section located outward of the border section of the stationary blade is bent in the rotational direction of the rotor. Therefore, the stagnation line formed in the bent section is also situated closer to the side of the rotational direction of the rotor than the stagnation line formed in the section that is not bent. Thus, the stagnation lines that are formed in various heights in the heightwise direction of the stationary blade are generally aligned in the rotational direction of the rotor. Therefore, fluctuation of pressure distribution of combustion gas flowing along the stationary blade with respect to a position in the heightwise direction of the stationary blade can be reduced. As a result, secondary flow loss can be reduced and turbine efficiency can be improved.

Advantageously, in the blade structure of a gas turbine, in each of the stationary blades, a width of the stationary blade in a part of the section located outward of the border section in the radial direction is smaller than a width of a section located inward of the border section in the radial direction.

According to the present invention, a width, in the direction of the rotating axis, of at least a part of the section of the stationary blade located outward of the border section in the radial direction is smaller than a width, in the direction of the rotating axis, of the section located inward of the border section in the radial direction. Thus, the section having a smaller width in the direction of the rotating axis obtains an effect of having a larger aspect ratio. Therefore, the combustion gas flowing from the rotor blade to the stationary blade flows differently in the section having a narrow width in the direction of the rotating axis and other areas. Thus, even if combustion gas leaking from the gap between the casing and the rotor blade flows near the leading edge of the stationary blade located downstream of the rotor blade and flows into the side of the back surface near the outer edge portion, the combustion gas flows differently because a width of the section in the direction of the rotating axis is smaller than a width of the other sections. Therefore, a secondary flow hardly occurs. As a result, reduction of secondary flow loss and improvement of turbine efficiency can be further ensured.

According to another aspect of the present invention, a blade structure of a gas turbine includes stationary blades that are arranged annularly in a casing and rotor blades that are arranged annularly on a rotor that is rotatable about a rotating axis. The stationary blades and the rotor blades are alternately provided to form a plurality of stages in a rotating axis direction, and a gap is provided between outer edge portions of the rotor blades and the casing. Assuming that a height of each of the stationary blades in a radial direction of the rotor is 100%, each of the stationary blades located downstream of the rotor blade between which and the casing the gap is provided includes a border section at a position of about 80% of the height of the stationary blade outward in the radial direction from an inner edge portion of the stationary blade, and a width in the rotating axis direction of at least a part of a section located outward of the border section in the radial direction is smaller than a width of a section located inward of the border section in the radial direction.

According to the present invention, a width, in the direction of the rotating axis, of at least a part of the section of the stationary blade located outward of the border section in the radial direction is smaller than a width, in the direction of the rotating axis, of the section located inward of the border section in the radial direction. Thus, the section having a smaller width in the direction of the rotating axis obtains an effect of having a larger aspect ratio. Therefore, the combustion gas flowing from the rotor blade to the stationary blade flows differently in the section having a narrow width in the direction of the rotating axis and other areas. Thus, even if combustion gas leaking from the gap between the casing and the rotor blade flows near the leading edge of the stationary blade located downstream of the rotor blade and to the side of the back surface near the outer edge portion, the combustion gas flows differently because a width of the section in the direction of the rotating axis is smaller than a width of the other sections. Therefore, a secondary flow hardly occurs. As a result, secondary flow loss can be reduced and turbine efficiency can be improved.

Advantageously, in the blade structure of a gas turbine, in an end wall, that is,. a wall surface, on which the stationary blades are provided in the casing includes a concave portion so that a part of the end wall located closer to the rotational direction side of the rotor than a center of the stationary blades is further concaved compared with a part of the end wall located closer to an opposite direction side of the rotational direction of the rotor than the center.

According to the present invention, a section of the end wall between two stationary blades neighboring in the rotational direction of the rotor includes a concave portion in a position located closer to the rotational direction of the rotor than the center of the stationary blades so that the concave portion is further concaved compared with a section of the end wall located closer to the opposite direction side of the rotational direction of the rotor than the center. More specifically, in two stationary blades neighboring in the rotational direction of the rotor, the stationary blade situated closer to the rotational direction of the rotor has the back surface thereof facing the other stationary blade, and the stationary blade situated closer to the opposite direction side of the rotational direction of the rotor has the ventral surface thereof facing the other stationary blade. If the rotor is rotated, in the stationary blade a pressure at the back surface is more likely to be higher than a pressure at the ventral surface due to combustion gas flowing from the rotor blade to the stationary blade. Because of the difference between the pressures, a secondary flow is likely to occur. By providing the concave portion in the end wall as described above, however, there is more space near the back surface. As a result, such secondary flow can be reduced.

More specifically, on the rotational direction side of the rotor than the center of the stationary blades, a back surface out of the back surface and a ventral surface of opposing stationary blades is located, while on the opposite direction side of the rotational direction of the rotor than the center, the ventral surface out of the back surface and the ventral surface two of which oppose each other is located. Therefore, by providing a concave portion on the end wall in a position located closer to the rotational direction of the rotor than the center of the stationary blades so that the concave portion is further concaved compared with a part of the end wall in a position closer to the opposite direction of the rotational direction of the rotor than the center, there is more space near the back surface. By providing the concave portion in the end wall and by thus providing more space near the back surface, pressures applied on the sides of the back surface and the ventral surface are generally equal to each other. Thus, even if combustion gas leaking from the gap between the casing and the rotor blade flows into the vicinity of the outer edge portion of the stationary blade, a difference in the pressures applied near the back surface of a stationary blade and near the ventral surface of another stationary blade two of which oppose each other is reduced. Therefore, a secondary flow caused by the pressure difference can be reduced. As a result, reduction of secondary flow loss and improvement of turbine efficiency can be further ensured.

EFFECT OF THE INVENTION

The blade structure of a gas turbine according to the present invention can efficiently reduce secondary flow loss and improve turbine efficiency.

EXPLANATIONS OF LETTERS OR NUMERALS

Figure 1:
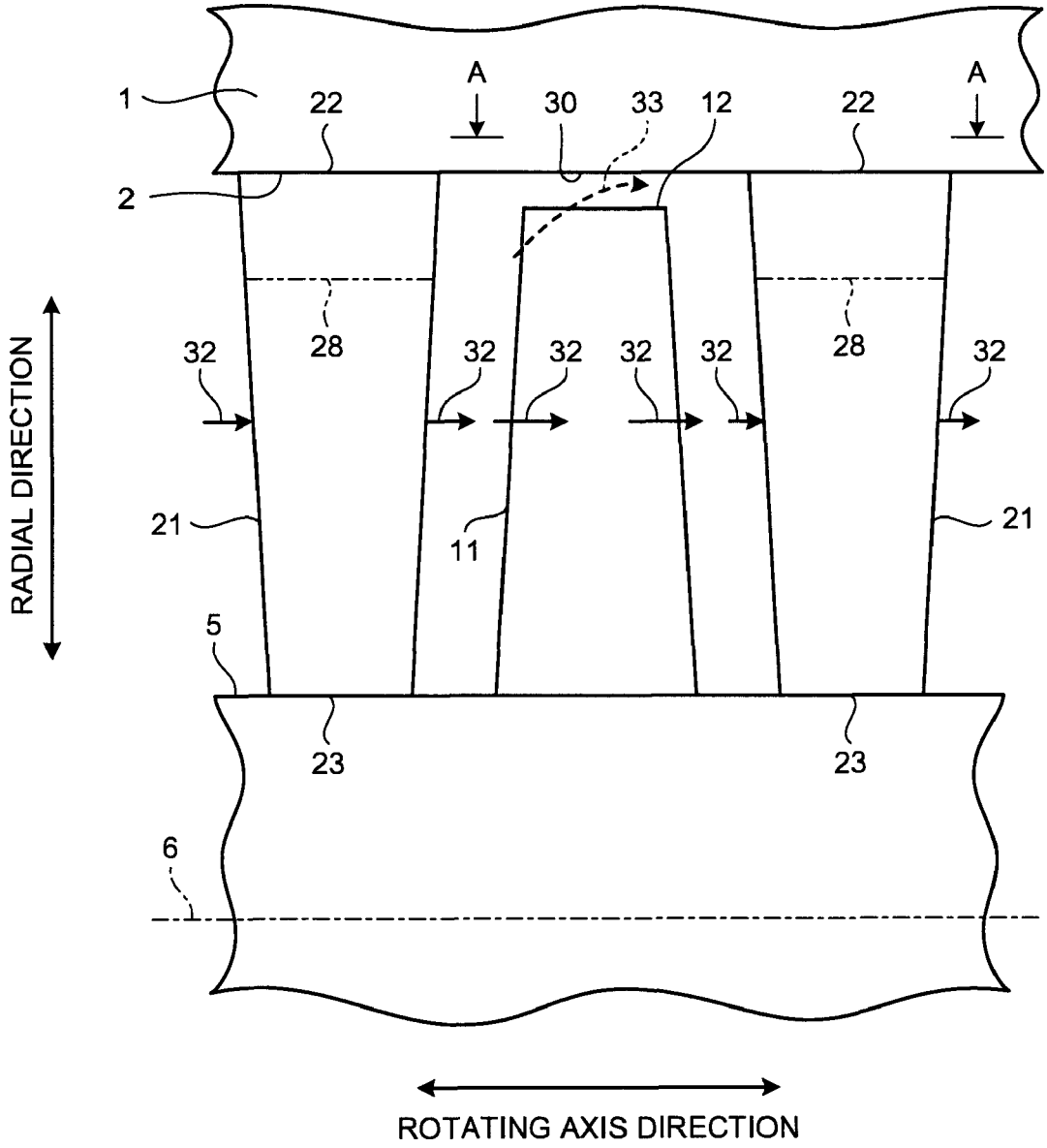
FIG. 1 is a schematic for explaining a rotor blade and a stationary blade showing a blade structure of a gas turbine according to a first embodiment.

1, 61 casing
2, 62 end wall
5, 65 rotor
6, 66 rotating axis
11, 71 rotor blade
12, 72 tip portion
14, 74 back surface
15, 75 ventral surface
16, leading edge
17, trailing edge
21, 41, 81 stationary blade
22, 82 tip portion
23, 83 inner edge portion
24, 84 back surface
25, 85 ventral surface
26, 86 leading edge
27, 87 trailing edge
28, border section
30, 90 tip clearance
32, 92 main flow
33, 93 leakage flow
35, 96 stagnation line
38, 98 flow direction
39, 99 constant pressure line
42, narrow width section
45, narrow width flow direction
46,constant width flow direction
51, end wall
52, deepest section
53, contour line
101 loss line for bent-shaped-stationary-blade
102 loss line for concave-shaped-end-wall
105 loss line for conventional-shape

BEST MODE(S) FOR CARRYING OUT THE INVENTION

Exemplary embodiments of a blade structure of a gas turbine according to the present invention are described below in greater detail with reference to the accompanying drawings. The present invention is, however, not limited thereto. The constituent elements described in the embodiments below include modifications that those skilled in the art can easily replace with or modifications that are substantially similar thereto. In the descriptions below, the rotating axis direction means the direction parallel to a rotating axis 6 of a rotor 5 that is described later, and the radial direction means the direction perpendicular to the rotating axis 6. The circumferential direction means the direction of circumference when the rotor 5 rotates about the rotating axis 6 as the center of rotation, and the rotational direction means the direction of rotation performed by the rotor 5 rotating about the rotating axis 6.

First Embodiment

FIG. 1 is a schematic for explaining a rotor blade and a stationary blade showing a blade structure of a gas turbine according to a first embodiment. Similar to a blade structure of a conventional gas turbine, the blade structure of a gas turbine shown in FIG. 1 includes a plurality of stages of stationary blades 21 arranged annularly on a casing 1 and a plurality of stages of rotor blades 11 arranged annularly on the rotor 5 that are rotatable about the rotating axis 6 during operation performed by the gas turbine. More specifically, the rotor 5 is provided in the casing 1, and the casing 1 includes an end wall 2, that is, a wall forming an inner circumferential surface of the casing 1 and opposing the rotor 5. A plurality of stationary blades 21 is connected to the end wall 2 and formed from the end wall 2 toward the rotor 5. The stationary blades 21 are arranged annularly along the circumferential direction so that there is a predetermined space between neighboring stationary blades 21.

The plurality of rotor blades 11 is connected to the rotor 5 and formed from the rotor 5 toward the end wall 2 of the casing 1. The rotor blades 11 are arranged annularly along the circumferential direction so that there is a predetermined space between neighboring rotor blades 11. The stationary blades 21 and the rotor blades 11 thus formed are alternately arranged in the rotating axis direction,. that is,. the direction parallel to the rotating axis 6 of the rotor 5. Thus, a plurality of stages of the stationary blades 21 and the rotor blades 11 is formed in the rotating axis direction. Each rotor blade 11 is separated from the casing 1. A tip clearance 30 is provided between a tip portion 12 that is,. an outer edge portion of each rotor blade 11 in the radial direction and the end wall 2 of the casing 1, as a gap therebetween.

Figure 2:
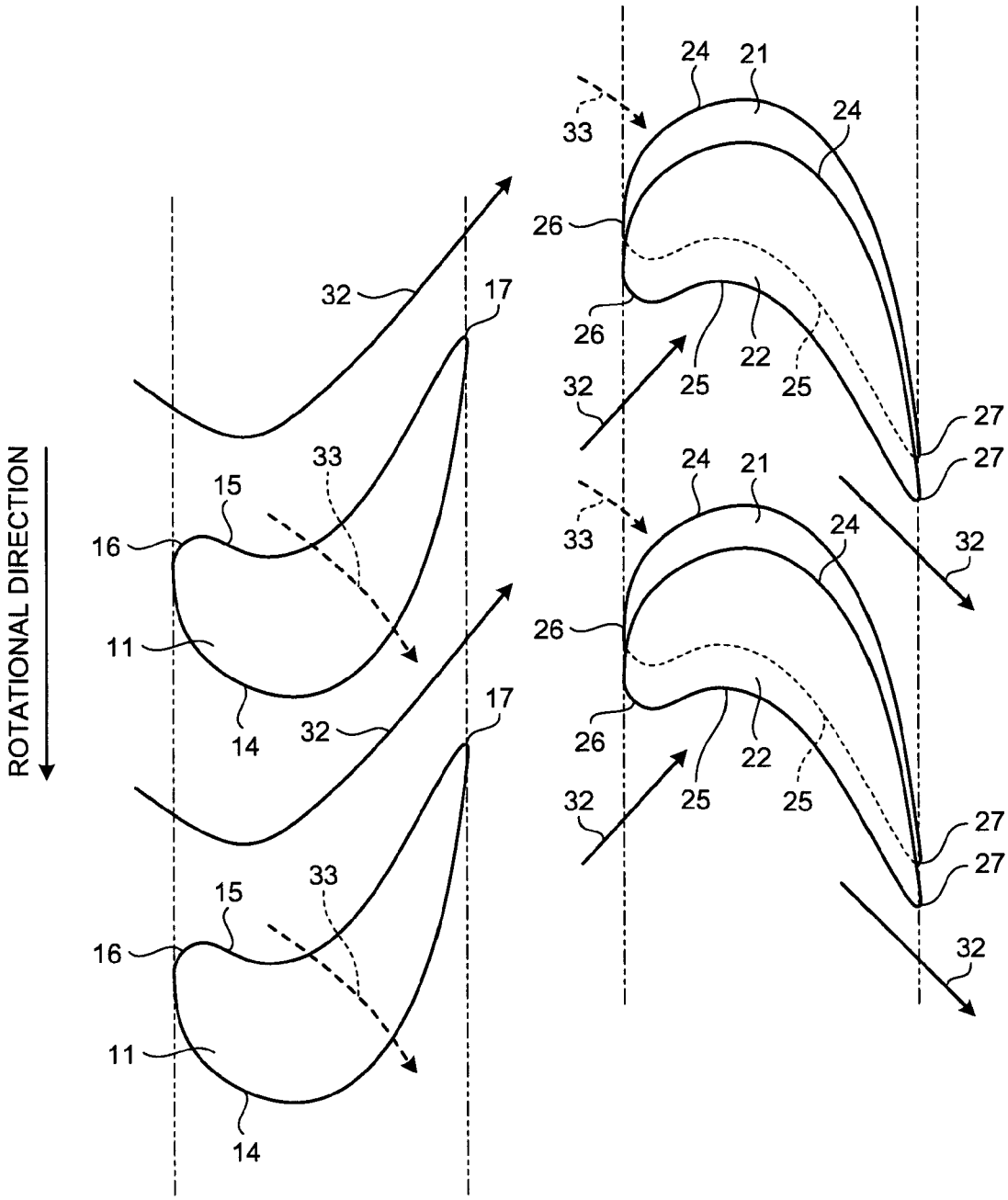
FIG. 2 is a sectional view cut along the line A-A of FIG. 1.
Figure 3:
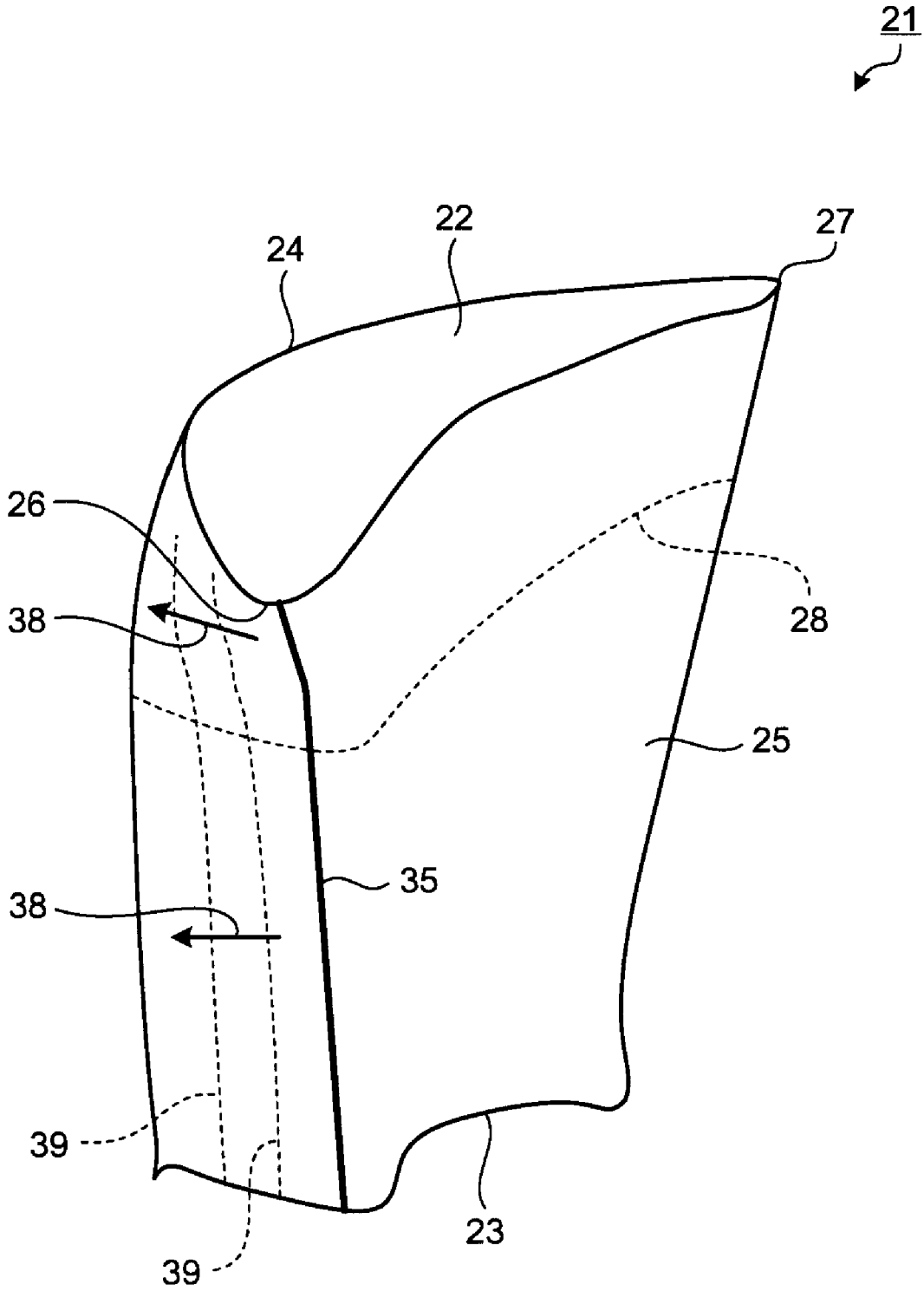
FIG. 3 is a perspective view of the stationary blade shown in FIG. 2.
Figure 4:
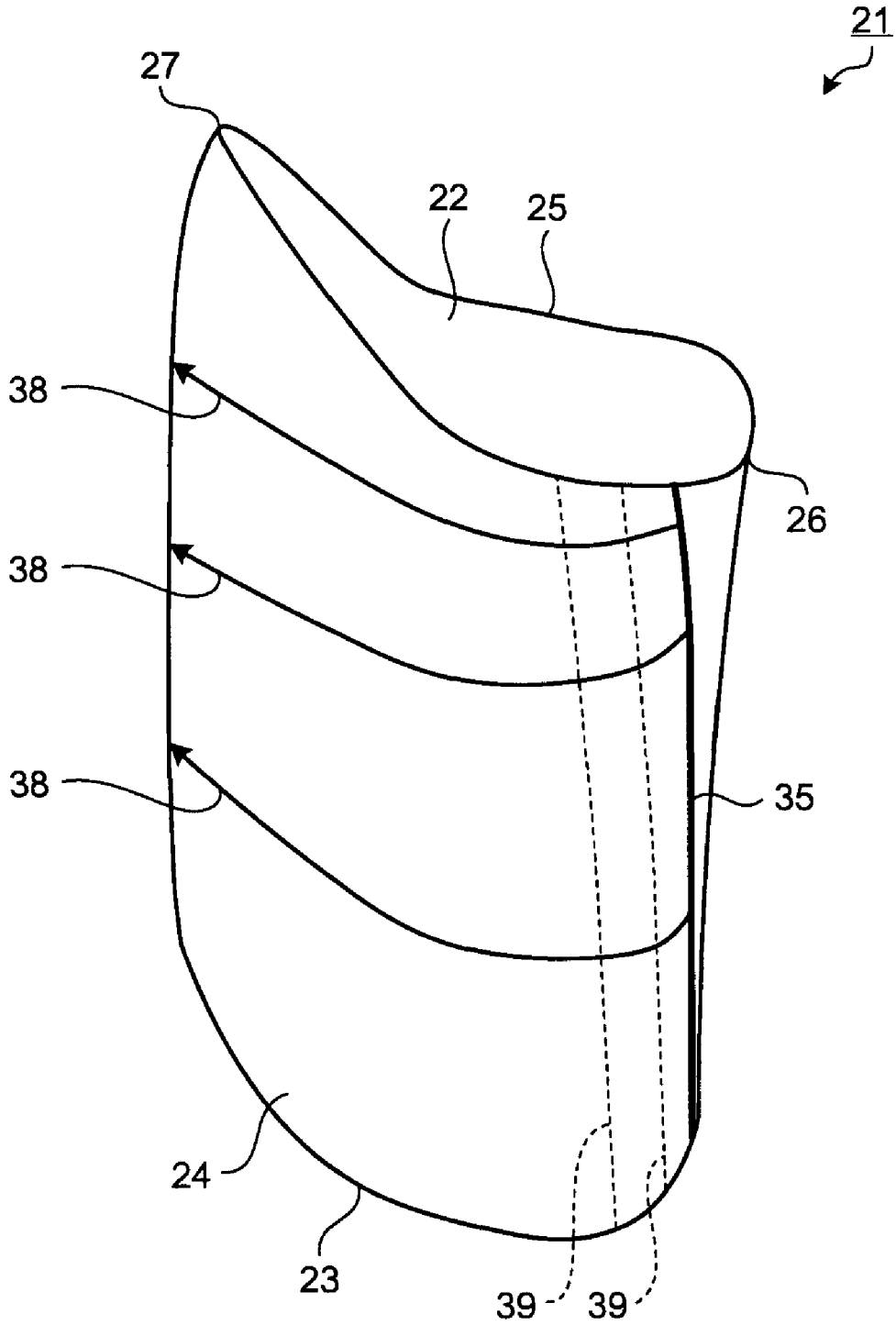
FIG. 4 is a perspective view of the stationary blade shown in FIG. 2.

FIG. 2 is a sectional view cut along the line A-A of FIG. 1. FIGS. 3 and 4 are perspective views of the stationary blade shown in FIG. 2. Shapes of each rotor blade 11 and each stationary blade 21 seen in the radial direction are both curved in the circumferential direction. More specifically, the rotor blade 11 is curved so that the rotor blade 11 is convexed toward the rotational direction of the rotor 5, and the stationary blade 21 is convexed toward the opposite direction of the rotational direction of the rotor 5. That is, the stationary blade 21 is convexed toward the opposite of the direction in which the rotor blade 11 is convexed. Each rotor blade 11 and each stationary blade 21 that are thus formed having curved surfaces each have a convexed surface and a concaved surface in the circumferential direction. The convexed surfaces form back surfaces 14 and 24, and the concaved surfaces form ventral surfaces 15 and 25. More specifically, in each rotor blade 11, the surface toward the rotational direction forms the back surface 14, and the surface toward the opposite of the rotational direction forms the ventral surface 15. On the other hand, in each stationary blade 21, the surface toward the opposite of the rotational direction forms the back surface 24, and the surface toward the rotational direction forms the ventral surface 25.

In each rotor blade 11, the edge toward the upstream direction of the combustion gas flowing near the rotor blade 11 while the rotor 5 is rotated forms a leading edge 16, and the edge toward the downstream direction forms a trailing edge 17. In the leading edge 16 and the trailing edge 17, the leading edge 16 is positioned closer to the rotational direction than the trailing edge 17. In each rotor blade 11, a width thereof in the circumferential direction, that is, a distance between the back surface 14 and the ventral surface 15, at a certain point between the leading edge 16 and the trailing edge 17 fluctuates as the point moves from the leading edge 16 to the trailing edge 17. More specifically, seen in the direction from the leading edge 16 to the trailing edge 17, as a distance between the leading edge 16 and the point increases, a width thereof increases accordingly until the width becomes the largest. Then, as the point moves closer to the trailing edge 17, a width thereof decreases accordingly. The point at which the width becomes the largest is situated closer to the leading edge 16 than the center of the leading edge 16 and the trailing edge 17.

Similarly, also in each stationary blade 21, the edge toward the upstream direction of the combustion gas flowing near the stationary blade 21 while the rotor 5 is rotated forms a leading edge 26, and the edge toward the downstream direction forms a trailing edge 27. In the leading edge 26 and the trailing edge 27, contrary to the leading edge 16 and the trailing edge 17 of the rotor blade 11, the leading edge 26 is positioned closer to the opposite direction side of the rotational direction than the trailing edge 27. In the stationary blade 21, a width thereof in the circumferential direction, that is a distance between the back surface 24 and the ventral surface 25, at a certain point between the leading edge 26 and the trailing edge 27 fluctuates as the point moves from the leading edge 26 to the trailing edge 27, similar to the rotor blade 11. The point at which the width becomes the largest is situated closer to the leading edge 26 than the center of the leading edge 26 and the trailing edge 27.

In the rotor blade 11 and the stationary blade 21, the portion near a tip portion 22 that is the outer edge portion, in the radial direction, of the stationary blade 21 positioned downstream of the rotor blade 11 to which the tip clearance 30 is provided in the flow direction of combustion gas flowing along the rotor blade 11 and the stationary blade 21 while the rotor 5 is rotated is bent in the rotational direction of the rotor 5. More specifically, in the stationary blade 21, assuming that the distance in the radial direction between an inner edge portion 23 of the stationary blade 21 and the tip portion 22 thereof, that is, the height in the radial direction of the rotor 5 of the stationary blade 21, is 100%, the position that is generally 80% of the height of the stationary blade 21 outwardly from the inner edge portion 23 in the radial direction forms a border section 28. In the stationary blade 21, at least a part of the portion located radially outward of the border section 28 is bent in the rotational direction of the rotor 5. Thus, the tip portion 22 of the stationary blade 21 is formed closer to the rotational direction of the rotor blade 11 than the inner edge portion 23.

Here, the position of the border section 28 is set to be generally 80% of the height of the stationary blade 21 outwardly from the inner edge portion 23 in the radial direction. The border section 28 is, however, preferably set according to a range where a leakage flow 33, that is, described later, flows (see FIGS. 5 and 6). When fluids flow, a condition of the fluids gradually fluctuates in a border section of the fluids, that is, flow rates thereof gradually fluctuate. Therefore, a border section of the fluids does not form a clear boundary, but has a certain width. Thus, a border section of a range in which only a main flow 32 flows into the stationary blade 21 and a range in which fluid containing the leakage flow 33 flows thereinto also has a certain width. Therefore, the border section 28 that is, set according to a range in which the leakage flow 33 flows may be at 80% of the height of the stationary blade 21 outwardly from the inner edge portion 23 in the radial direction. To be more accurate, however, the border section 28 is preferably generally at 80% of the height of the stationary blade 21 outwardly from the inner edge portion 23 in the radial direction.

A blade structure of a gas turbine according to the first embodiment is configured as described above. Functions thereof are described below. While the gas turbine is in operation, the rotor 5 rotates about the rotating axis 6. Thus, the rotor blades 11 connected to the rotor 5 also rotate about the rotating axis 6 in the rotational direction of the rotor 5. When each rotor blade 11 rotates, combustion gas flows into the stationary blade located downstream of the rotor blade 11 because the rotor blade 11 is convexed toward the rotational direction and the leading edge 16 is closer to the rotational direction than the trailing edge 17. Then, the combustion gas flows along the shape near the following edge trailing edge 17 of the rotor blade 11. Therefore, the combustion gas flowing from the rotor blade 11 to the stationary blade 21 flows in the opposite of the rotational direction while flowing from the upstream side to the downstream side.

Thus, the main flow 32 of the combustion gas that is a flow of a greater part of the combustion gas flows in the opposite of the rotational direction of the rotor blade 11. Therefore, when the main flow 32 of the combustion gas flows into the stationary blade 21, the main flow 32 flows from the side of the ventral surface 25, that is the surface toward the rotational direction, and flows in the direction along the shape of the stationary blade 21 near the leading edge 26. The main flow 32 of the combustion gas flowing into the stationary blade 21 flows along the shape of the stationary blade 21, that is, the shapes of the ventral surface 25 and the back surface 24 of the stationary blade 21. Therefore, the main flow 32 is rectified by the stationary blade 21, as well as the direction of the flow is altered. Then, the main flow 32 flows into the rotor blade 11 positioned downstream of the stationary blade 21.

When the main flow 32 of the combustion gas whose flow direction is altered by the stationary blade 21 flows from the stationary blade 21 to the rotor blade 11, the main flow 32 flows along the shape of the stationary blade 21 near the trailing edge 27. Therefore, when flowing from the stationary blade 21 to the rotor blade 11, the main flow 32 of the combustion gas flows against the rotational direction while flowing from the upstream side to the downstream side.

Thus, the main flow 32 of the combustion gas flows from the side of the ventral surface 15, that is, the surface located toward the opposite of the rotational direction of the rotor blade 11, and flows along the shape of the rotor blade 11 near the leading edge 16. The main flow 32 of the combustion gas that flows into the rotor blade 11 flows along the shape of the rotor blade 11, that is, the shapes of the ventral surface 15 and the back surface 14 of the rotor blade 11. Therefore, the flow direction of the main flow 32 of the combustion gas is altered by the rotor blade 11, and applies force to the rotor blade 11 in the rotational direction. In other words, the combustion gas applies force to the rotor blade 11 in the rotational direction by reaction of altering the flow direction of the combustion gas. Due to the force applied by the combustion gas, the rotor blade 11 and the rotor 5 to which the rotor blade 11 is connected rotate in the rotational direction.

When the main flow 32 of the combustion gas flows into the rotor blade 11, the main flow 32 of the combustion gas flows from the side of the ventral surface 15 of the rotor blade 11. Therefore, a pressure of the combustion gas flowing along the rotor blade 11 is higher on the side of the ventral surface 15 than on the side of the back surface 14. The tip clearance 30 is, however, provided between the tip portion 12 of the rotor blade 11 and the end wall 2 of the casing 1. Therefore, a part of the combustion gas situated on the side of the ventral surface 15 of the rotor blade 11 flows from the side of the ventral surface 15 on which a higher pressure is applied to the side of the back surface 14 on which a lower pressure is applied via the tip clearance 30 because of a pressure difference between the ventral surface 15 and the back surface 14. The leakage flow 33, that is, a flow of the combustion gas leaking from the tip clearance 30, flows in the rotational direction while flowing from the upstream side to the downstream side of the combustion gas. Thus, when the leakage flow 33 of the combustion gas leaking from the tip clearance 30 flows into the stationary blade 21, the leakage flow 33 of the combustion gas flows near the leading edge 26 of the stationary blade 21 from the back surface 24, that is, the surface located closer to the opposite direction side of the rotational direction, and flows in the direction along the shape of stationary blade 21 near the tip portion 22. In the stationary blade 21, the area that the leakage flow 33 from the tip clearance 30 hits is mainly located more radially outward with respect to the border section 28.

Figure 5:
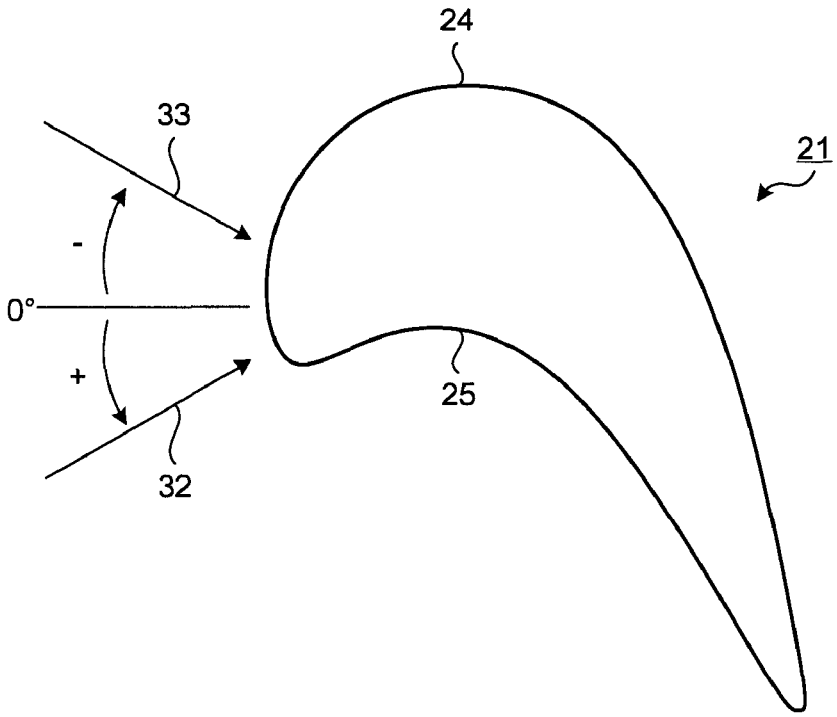
FIG. 5 is a schematic for explaining an inflow angle of combustion gas flowing into a stationary blade.
Figure 6:
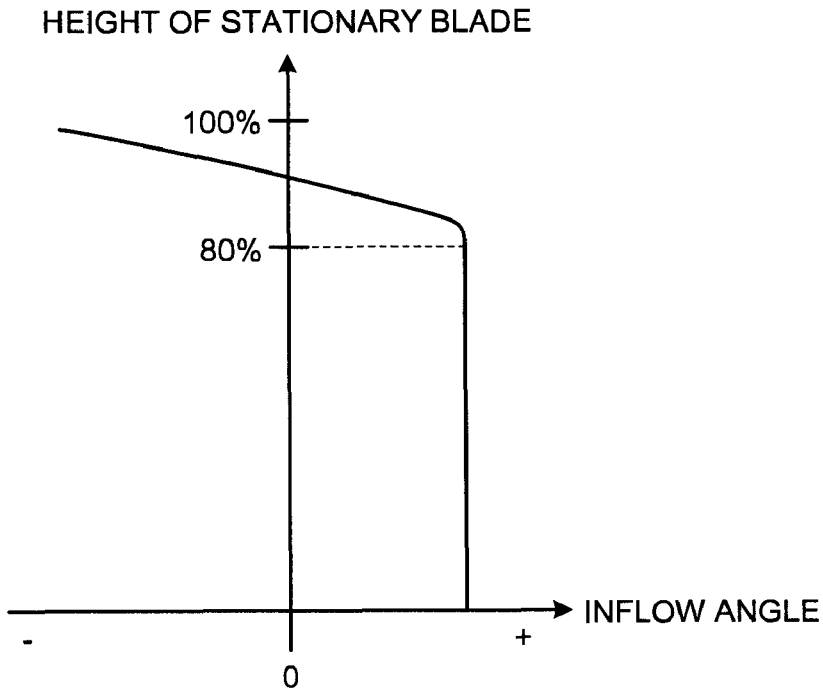
FIG. 6 is a distribution diagram of inflow angles of combustion gas at different positions in the heightwise direction of a stationary blade.

FIG. 5 is a schematic for explaining an inflow angle of combustion gas flowing into a stationary blade. FIG. 6 is a distribution diagram of inflow angles of combustion gas in different positions in the heightwise direction of a stationary blade. More specifically, an inflow angle of combustion gas flowing into the stationary blade 21 is so defined that the rotational direction is 0 degree, an inflow angle of combustion gas flowing from the side of the ventral surface 25 has a positive value, and an inflow angle of combustion gas flowing from the side of the back surface 24 has a negative value. That is, the main flow 32 of combustion gas has a positive value, and the leakage flow 33 of combustion gas has a negative value. Then, in distribution of inflow angles of combustion gas flowing into the stationary blade 21, an inflow angle has a positive value up to the position of generally 80% of the height of the stationary blade in the heightwise direction of the stationary blade, and as the position moves toward 100% over generally 80%, a value of inflow angle decreases accordingly and turns into a negative value. In combustion gas flowing into the stationary blade 21, the main flow 32 flows up to the position of generally 80% of the height of the stationary blade 21, and fluid containing the leakage flow 33 flows between generally 80% to 100%.

If combustion gas flows from the rotor blade 11 to the stationary blade 21, the combustion gas branches into two parts, that is, the side of the back surface 24 and the side of the ventral surface 25 of the stationary blade 21. Therefore, at the branching area between the two parts, a stagnation line 35 is formed that is an area to which a higher pressure is applied. When the combustion gas flows into the stationary blade 21, the main flow 32 flows from the side of the ventral surface 25 of the stationary blade 21. On the other hand, the leakage flow 33 flows from the side of the back surface 24 of the stationary blade 21. Thus, a relative position of the stagnation line 35 with respect to the back surface 24 and the ventral surface 25 differs in the area hit by the main flow 32 of the combustion gas and in the area hit by the leakage flow 33 from the tip clearance 30. More specifically, the stagnation line 35 in the area hit by the leakage flow 33 from the tip clearance 30 is formed closer to the side of the back surface 24 than the stagnation line 35 in the area hit by the main flow 32 of the combustion gas.

A relative position of the stagnation line 35 with respect to the back surface 24 and the ventral surface 25 differs in the area hit by the leakage flow 33 from the tip clearance 30 and in the area hit by the main flow 32 of the combustion gas. The section located radially outward of the border section 28 that is the area hit by the combustion gas leaking from the tip clearance 30 is, however, bent in the rotational direction of the rotor 5. Thus, the stationary blade 21 is formed so that the section thereof radially outward of the border section 28 is shifted toward the side of the ventral surface 25.

Therefore, the stagnation line 35 in the section is also shifted toward the rotational direction of the rotor 5, that is toward the side of the ventral surface 25 of the stationary blade 21. As a result, the position of the stagnation line 35 in the section radially outward of the border section 28 and the position of the stagnation line 35 in the section radially inward of the border section 28 that is the area hit by the main flow 32 of the combustion gas are generally the same in the rotational direction of the rotor 5. Therefore, the stagnation line 35 is formed so that the stagnation line 35 is extended generally linearly in the radial direction of the rotor 5, that is the heightwise direction of the stationary blade 21. Thus, the stagnation line 35 is formed generally linearly in the radial direction. Therefore, a pressure of the combustion gas flowing along the stationary blade 21 is generally constant in the radial direction, and constant pressure lines 39 that show distribution of pressure of the combustion gas are also formed so as to be extended generally linearly in the radial direction as shown in FIGS. 3 and 4.

Therefore, a flow direction 38 of the combustion gas that branches at the stagnation line 35 into the side of the back surface 24 and the side of the ventral surface 25 does not direct toward the heightwise direction of the stationary blade 21 so much, but is directed from the side of the leading edge 26 to the trailing edge 27. Thus, pressure fluctuation, in the heightwise direction of the stationary blade 21, of the combustion gas flowing along the stationary blade 21 is reduced, thereby reducing a secondary flow loss.

Figure 7:
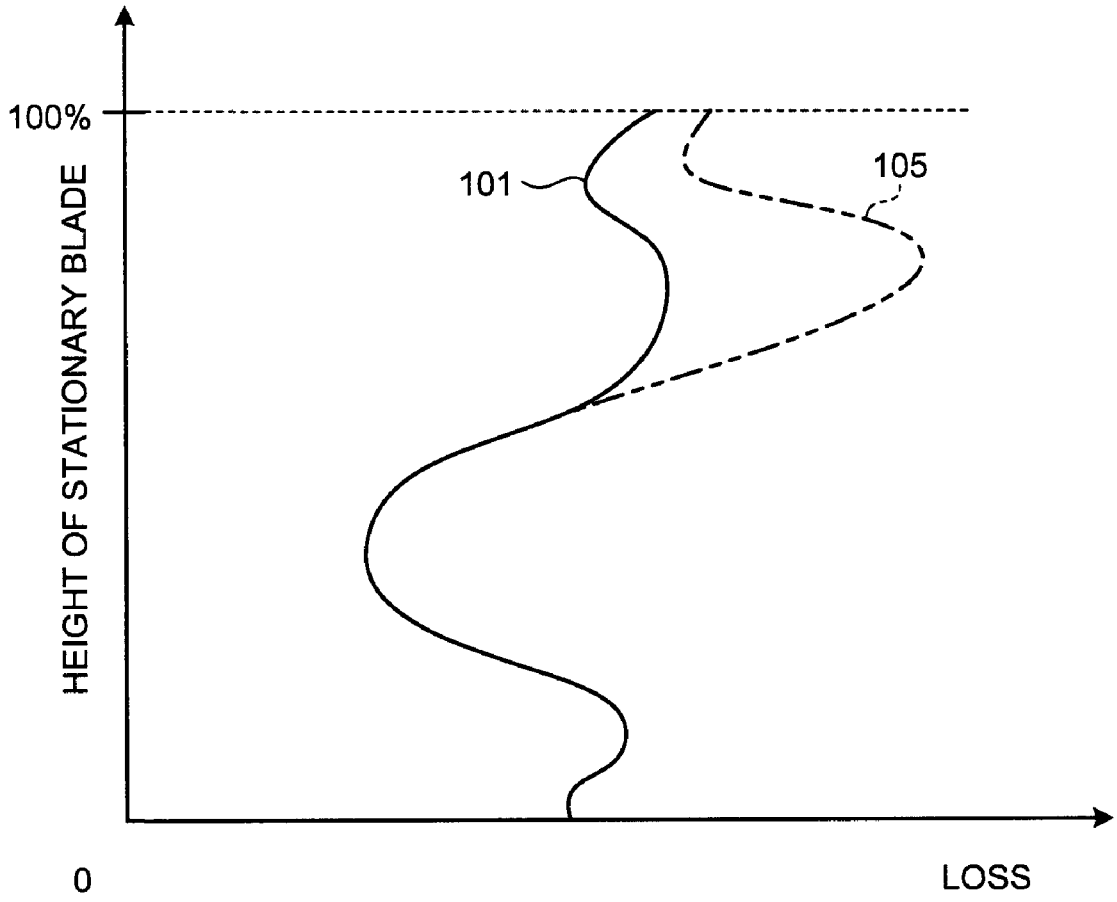
FIG. 7 is a diagram for explaining the distribution of loss in different positions in the heightwise direction of a stationary blade.

FIG. 7 is a diagram for explaining the distribution of loss in different positions in the heightwise direction of the stationary blade. As shown in FIG. 7, by bending the stationary blade 21 so that the section radially outward of the border section 28 is shifted toward the side of the ventral surface 25, secondary flow loss of the combustion gas flowing along the stationary blade 21 is reduced. Therefore, loss caused by the combustion gas flowing into the stationary blade 21 is reduced. More specifically, near the tip portion 22 of the stationary blade 21, that is, near 100% in the heightwise direction of the stationary blade 21, mostly the leakage flow 33 of the combustion gas flows. Therefore, if a shape of a stationary blade in a conventional blade structure of a gas turbine is employed, secondary flow is generated near 100% in the heightwise direction of the stationary blade 21, thereby increasing loss. Thus, loss distribution in the heightwise direction of the stationary blade 21 is increased at nearly 100% in the heightwise direction of the stationary blade 21. In a loss line for conventional-shape 105 that shows loss distribution in the heightwise direction of the stationary blade 21 of which the section radially outward of the border section 28 is not bent in the direction of the ventral surface 25, loss increases at nearly 100%.

On the other hand, if the stationary blade 21 is bent so that the section radially outward of the border section 28 is shifted toward the side of the ventral surface 25, secondary flow loss is reduced. Therefore, loss distribution in the heightwise direction of the stationary blade 21 is reduced near the 100% in the heightwise direction of the stationary blade 21 with respect to a conventional shaped stationary blade. Thus, in a loss line for bent-shaped-stationary-blade 101 that shows loss distribution in the heightwise direction of the stationary blade 21 in a blade structure of a gas turbine according to the first embodiment, the loss at nearly 100% is smaller than in the loss line for conventional-shape 105.

In the blade structure of a gas turbine described above, at least a part of the section located radially outward of the border section 28 is bent in the rotational direction of the rotor 5. Therefore, the stagnation lines 35 can be generally aligned in the rotational direction of the rotor 5. Thus, if combustion gas leaks from the tip clearance 30 between the end wall 2 of the casing 1 and each rotor blade 11, the combustion gas flows near the leading edge 26 of the stationary blade 21 located downstream of the rotor blade 11 and flows into the side of the back surface 24 near the tip portion 22 of the stationary blade 21. Therefore, the stagnation line 35 outward of the border section 28 has a tendency to be situated closer to the side of the back surface 24 than the stagnation line 35 formed in the other section, that is, the section located radially inward of the border section 28. The section of the stationary blade 21 located radially outward of the border section 28, however, is bent in the direction of the rotational direction of the rotor 5.

Therefore, the stagnation line 35 formed in the bent section is also situated closer to the side of the rotational direction of the rotor 5 than the stagnation line 35 formed in the section that is not bent. Thus, the stagnation lines 35 that are formed in various heights in the heightwise direction of the stationary blade 21 are generally aligned in the rotational direction of the rotor 5. Therefore, fluctuation of loss distribution in the heightwise direction of the stationary blade 21 can be reduced. As a result, secondary flow loss can be reduced and turbine efficiency can be improved.

Figure 8:
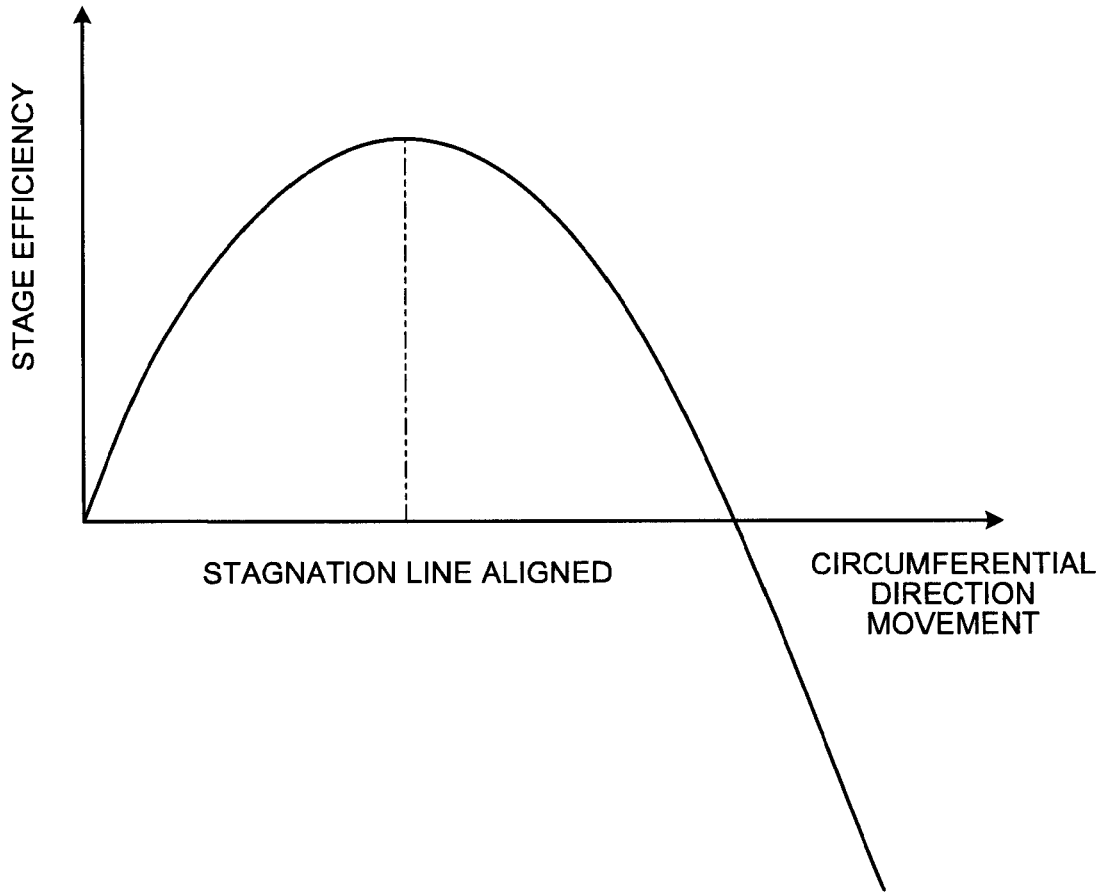
FIG. 8 is a diagram for explaining the relationship between a position of the stagnation line in the circumferential direction and stage efficiency.

The section located radially outward of the border section 28 can be preferably bent toward the side of the ventral surface 25 to a certain degree so that the stagnation line in the section located radially outward of the border section 28 is aligned in the circumferential direction with the stagnation line 35 in the section located radially inward of the border section 28. FIG. 8 is a diagram for explaining relationship between a position of the stagnation line in the circumferential direction and stage efficiency. As shown in FIG. 8, a stage efficiency that is a efficiency of a stage in which the stationary blade 21 is provided has the highest value if the stagnation line 35 in the section located radially outward of the border section 28 is aligned in the circumferential direction with the stagnation line 35 in the section located radially inward of the border section 28, and the more out of alignment the stagnation line 35 in the section located radially outward thereof and the stagnation line 35 in the section located radially inward thereof are, the less a stage efficiency becomes. Thus, the section located radially outward of the border section 28 is preferably bent so that the stagnation line 35 in the section located radially outward of the border section 28 is aligned in the circumferential direction with the stagnation line 35 in the section located radially inward of the border section 28.

Second Embodiment

Figure 9:
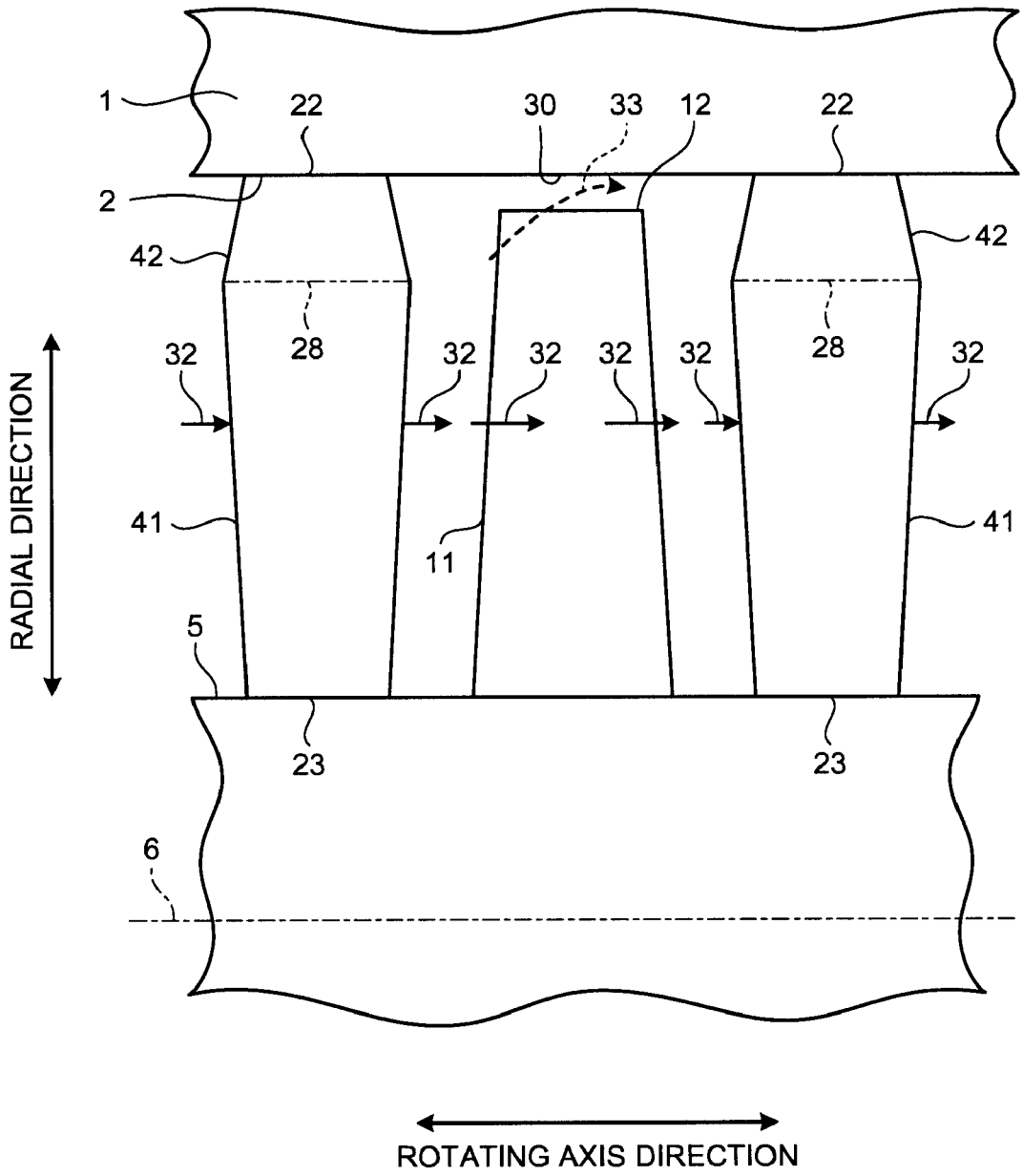
FIG. 9 is a schematic for explaining a blade structure of a gas turbine according to a second embodiment of the present invention.

A blade structure of a gas turbine according to a second embodiment of the present invention is configured so as to be generally similar to a blade structure of a gas turbine according to the first embodiment. According to the second embodiment, however, a width of each stationary blade in the rotating axis direction is modified, instead of bending the section located radially outward of the border section in the rotational direction. The other configuration is similar to the first embodiment. Therefore, descriptions thereof are omitted and the identical reference numerals in the first embodiment are used here. FIG. 9 is a schematic for explaining a blade structure of a gas turbine according to the second embodiment. As shown in FIG. 9, in a blade structure of a gas turbine according to the second embodiment, the rotor 5 that can rotate about the rotating axis 6 is provided in the casing 1. The plurality of rotor blades 11 arranged annularly is connected to the rotor 5. In the casing 1, a plurality of stationary blades 41 formed from the end wall 2 toward the rotor 5 is annularly arranged and is connected to the end wall 2. The stationary blades 41 and the rotor blades 11 thus formed are alternately arranged in the rotating axis direction of the rotor 5, and thus, a plurality of stages of the stationary blades 41 and the rotor blades 11 is formed in the rotating axis direction. The tip clearance 30 is provided between the tip portion 12 of each rotor blade 11 and the end wall 2 of the casing 1.

Figure 10:
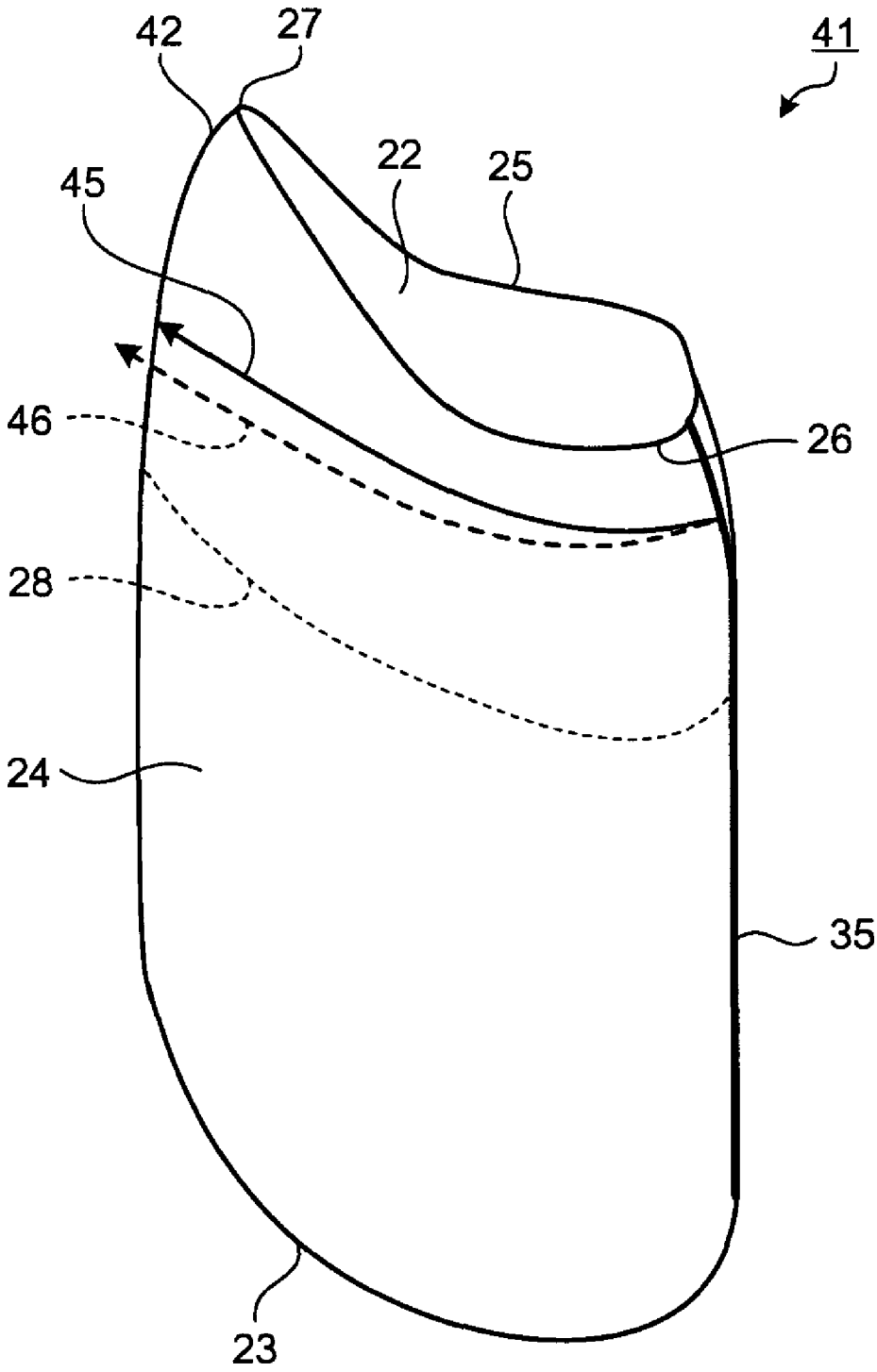
FIG. 10 is a perspective view of the stationary blade shown in FIG. 9.

FIG. 10 is a perspective view of the stationary blade shown in FIG. 9. In the rotor blades 11 and the stationary blades 41 thus configured, each stationary blade is so configured that the border section 28 is situated at the point generally 80% of the height of the stationary blade 41 radially outward from the inner edge portion 23 and that an axial chord, that is, a width in the rotating axis direction, of at least a part of the section located radially outward of the border section 28 is smaller than an axial chord of the section located radially inward of the border section 28. In the stationary blade 41, the section that is located outward of the border section 28 and of which the axial chord is smaller forms a narrow width section 42. In the narrow width section 42, a distance between the leading edge 26 and the trailing edge 27 in the rotating axis direction becomes smaller from the border section 28 to the tip portion 22. Thus, an axial chord thereof becomes smaller accordingly.

In the narrow width section 42, the axial chord is smaller than the axial chord in the section located radially inward of the border section 28. Thus, in the narrow width section 42, effect of having a larger aspect ratio can be obtained.

A blade structure of a gas turbine according to the second embodiment is configured as described above. Functions thereof are described below. While the gas turbine is in operation, the rotor 5 rotates about the rotating axis 6. Thus, the rotor blades 11 connected to the rotor 5 also rotate about the rotating axis 6 in the rotational direction of the rotor 5. Thus, combustion gas flows from the upstream side of each rotor blade 11 and each stationary blade 41 to the downstream side thereof.

When the main flow 32 of the combustion gas flowing from the upstream side to the downstream side flows into the stationary blade 41, the main flow 32 flows from the side of the ventral surface 25 that is the surface toward the rotational direction and flows in the direction along the shape of the stationary blade 41 near the leading edge 26. The main flow 32 of the combustion gas flowing into the stationary blade 41 is rectified by the stationary blade 41 and the flow direction thereof is altered thereby. Thus, the main flow 32 flows toward the rotor blade 11 located downstream of the stationary blade 41.

When the main flow 32 of the combustion gas whose flow direction is altered by the stationary blade 41 flows from the stationary blade 41 to the rotor blade 11, the main flow 32 flows from the side of the ventral surface 15 of the rotor blade 11. Thus, the flow direction thereof is altered by the rotor blade 11 and the main flow 32 applies force to the rotor blade 11 in the rotational direction. Thus, the combustion gas applies force to the rotor blade 11 in the rotational direction by reaction of altering the flow direction of the combustion gas. The force applied by the combustion gas rotates the rotor blade 11 and the rotor 5, to which the rotor blade 11 is connected, in the rotational direction.

When the main flow 32 of the combustion gas flows into the rotor blade 11, the main flow 32 of the combustion gas flows from the side of the ventral surface 15 of the rotor blade 11. Therefore, a pressure of the combustion gas flowing along the rotor blade 11 is higher on the side of the ventral surface 15 than on the side of the back surface 14. The tip clearance 30 is, however, provided between the tip portion 12 of the rotor blade 11 and the end wall 2 of the casing 1. Thus, a part of the combustion gas situated on the side of the ventral surface 15 of the rotor blade 11 flows from the side of the ventral surface 15 to the side of the back surface 14 as the leakage flow 33 flowing through the tip clearance 30 because of a pressure difference between the ventral surface 15 and the back surface 14. The leakage flow 33 flows in the rotational direction while flowing from the upstream side to the downstream side of the combustion gas. Therefore, when the leakage flow 33 flows into the stationary blade 41, the leakage flow 33 flows mainly into the narrow width section 42 so as to flow near the leading edge 26 of the stationary blade 41 from the side of the back surface 24 and to flow in the direction along the shape of the stationary blade 41 near the tip portion 22.

When the combustion gas flows from the rotor blade 11 to the stationary blade 41, the stagnation line 35 is formed. More specifically, in the heightwise direction of the stationary blade 41, the stagnation line 35 in the area hit by the leakage flow 33 from the tip clearance 30 is situated closer to the side of the back surface 24 than the stagnation line 35 in the area hit by the main flow 32 of the combustion gas. The stagnation line 35 is formed continuously in the radial direction. Therefore, the line formed by the stagnation line 35 that is formed continuously forms the stagnation line 35. The combustion gas flowing into the stationary blade 41 branches at the stagnation line 35 into the side of the back surface 24 and the side of the ventral surface 25.

Thus, the leakage flow 33 flows into the narrow width section 42 and the main flow 32 flows into the area located radially inward of the border section 28. At the border section 28, however, the axial chord is smaller. Therefore, effect of having a larger aspect ratio can be obtained.

Therefore, a narrow width flow direction 45 that is a flow direction of combustion gas from the stationary blade 41 near the leading edge 26 to the trailing edge 27 when the leakage flow 33 from the tip clearance 30 flows into the narrow width section 42 is not directed in the radial direction so much. The narrow width flow direction 45 is directed from the vicinity of the leading edge 26 to the trailing edge 27 along the shape of the stationary blade 41.

Thus, a flow component in the radial direction is smaller in the narrow width flow direction 45 than in a constant width flow direction 46 that is,. a flow direction of combustion gas when the leakage flow 33 flows from the upstream side to the downstream side if the stationary blade 41 is not provided with the narrow width section 42 and a width of the stationary blade 41 in the rotating axis direction is constant. Therefore, the flow direction of the combustion gas flowing from the vicinity of the leading edge 26 to the trailing edge 27 is not directed toward the heightwise direction of the stationary blade 41 so much, but is directed from the side of the leading edge 26 to the side of the trailing edge 27. As a result, pressure fluctuation, in the heightwise direction of the stationary blade 41, of the combustion gas flowing along the stationary blade 41 is reduced, thereby reducing secondary flow loss.

In the blade structure of the gas turbine, an axial chord of the narrow width section 42 of the stationary blade 41 is smaller than an axial chord of the area located radially inward of the border section 28. Thus, the narrow width section 42 obtains effect of having a larger aspect ratio. Therefore, the combustion gas flowing from the rotor blade 11 to the stationary blade 41 flows differently in the narrow width section 42 and the other areas. Therefore, even if the leakage flow 33 that is, a flow of combustion gas leaking from the tip clearance 30 flows near the leading edge 26 of the stationary blade 41 located downstream of the rotor blade 11 and flows into the side of the back surface 24 near the tip portion 22, secondary flow loss hardly occurs because the axial chord is smaller in the narrow width section 42 than in the other areas and the combustion gas flows differently therein. Thus, fluctuation of pressure distribution caused by the leakage flow 33 from the tip clearance 30 flowing into the stationary blade 41 located downstream of the rotor blade 11 and fluctuation of pressure distribution caused by having a different axial chord counteract each other, thereby reducing occurrence of secondary flow loss. As a result, secondary flow loss can be reduced and turbine efficiency can be improved.

Figure 11:
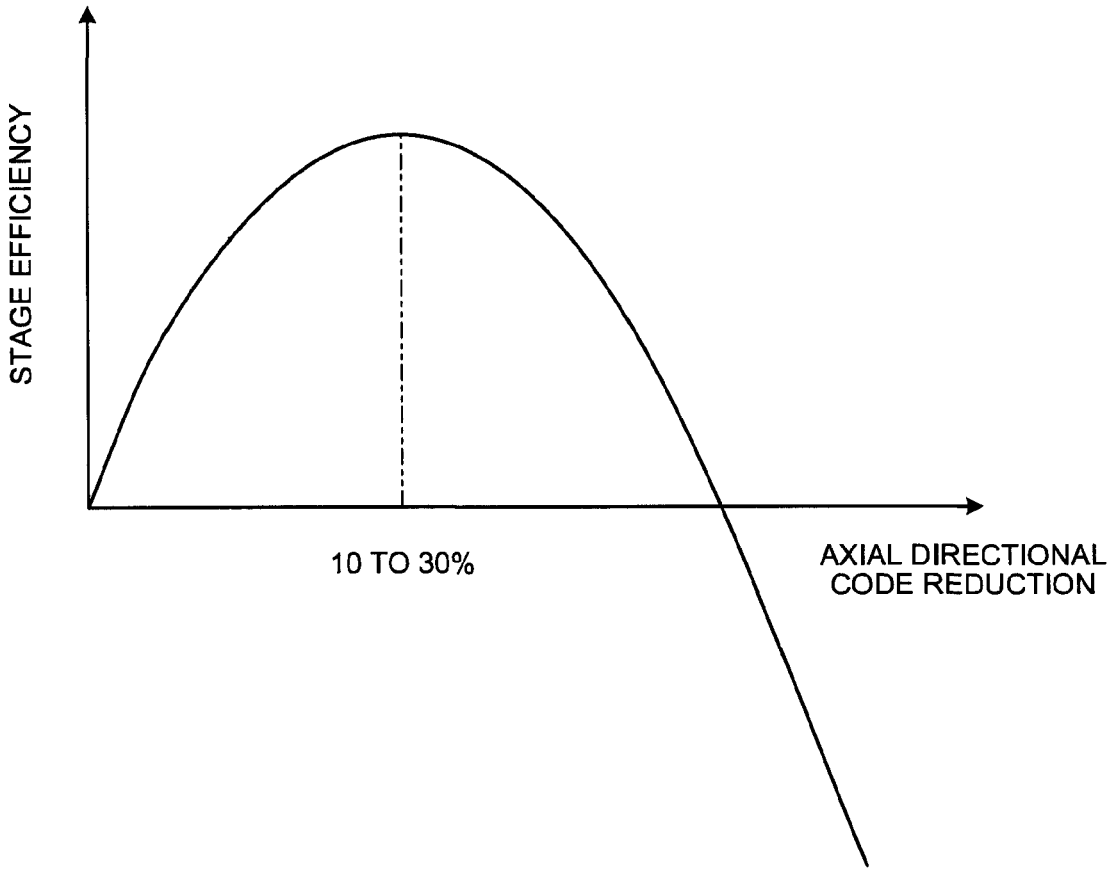
FIG. 11 is a diagram for explaining the relationship between degree of reducing an axial chord and stage efficiency.

The axial directional code of the narrow width section 42 can be preferably made smaller than an axial chord of the other areas located radially inward of the border section 28 so that the axial chord of the narrow width section 42 is smaller by 10% to 30% of the axial chords of the other areas. FIG. 11 is a diagram for explaining relationship between degree of reducing an axial chord and stage efficiency. As shown in FIG. 11, stage efficiency, that is, efficiency of the stage in which the stationary blade 41 is provided, becomes the highest if reduction of the axial chord is within a range of 10% to 30%, and as the amount of the reduction is more deviated from the range, stage efficiency becomes smaller. Therefore the axial chord of the narrow width section 42 can be preferably reduced by 10% to 30% of the axial chord of the area located radially inward of the border section 28.

Third Embodiment

Figure 12:
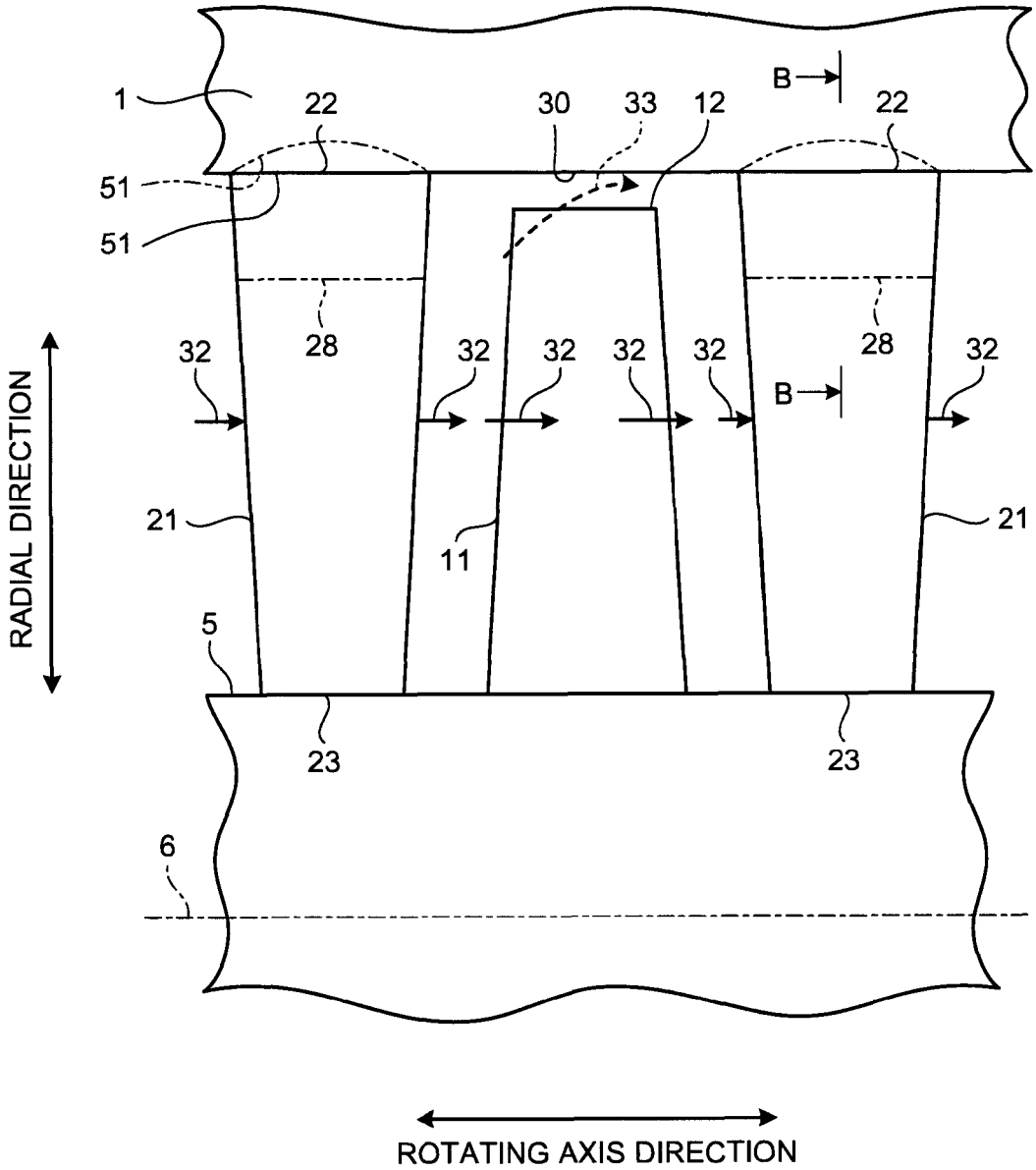
FIG. 12 is a schematic for explaining a blade structure of a gas turbine according to a third embodiment of the present invention.

A blade structure of a gas turbine according to a third embodiment is configured so as to be generally similar to a blade structure of a gas turbine according to the first embodiment. According to the third embodiment, however, the end wall of the casing is concaved. The other configuration is similar to the first embodiment. Therefore, descriptions thereof are omitted and the identical reference numerals in the first embodiment are used here. FIG. 12 is a schematic for explaining a blade structure of a gas turbine according to third embodiment. As shown in FIG. 12, in a blade structure of a gas turbine according to the third embodiment, the rotor 5 that can rotate about the rotating axis 6 is provided in the casing 1. A plurality of rotor blades 11 arranged annularly is connected to the rotor 5. The plurality of stationary blades 21 formed from an end wall 51 toward the rotor 5 is annularly arranged and is connected to the end wall 51. The stationary blades 21 and the rotor blades 11 thus formed are alternately arranged in the rotating axis direction of the rotor 5, and thus, a plurality of stages of the stationary blades 21 and the rotor blades 11 is formed in the rotating axis direction. The tip clearance 30 is provided between the tip portion 12 of each rotor blade 11 and the end wall 51 of the casing 1. Similar to a blade structure of a gas turbine according to the first embodiment, each stationary blade 21 is bent so that the section located radially outward of the border section 28 is shifted toward the side of the ventral surface 25 (See FIGS. 3 and 4).

Figure 13:
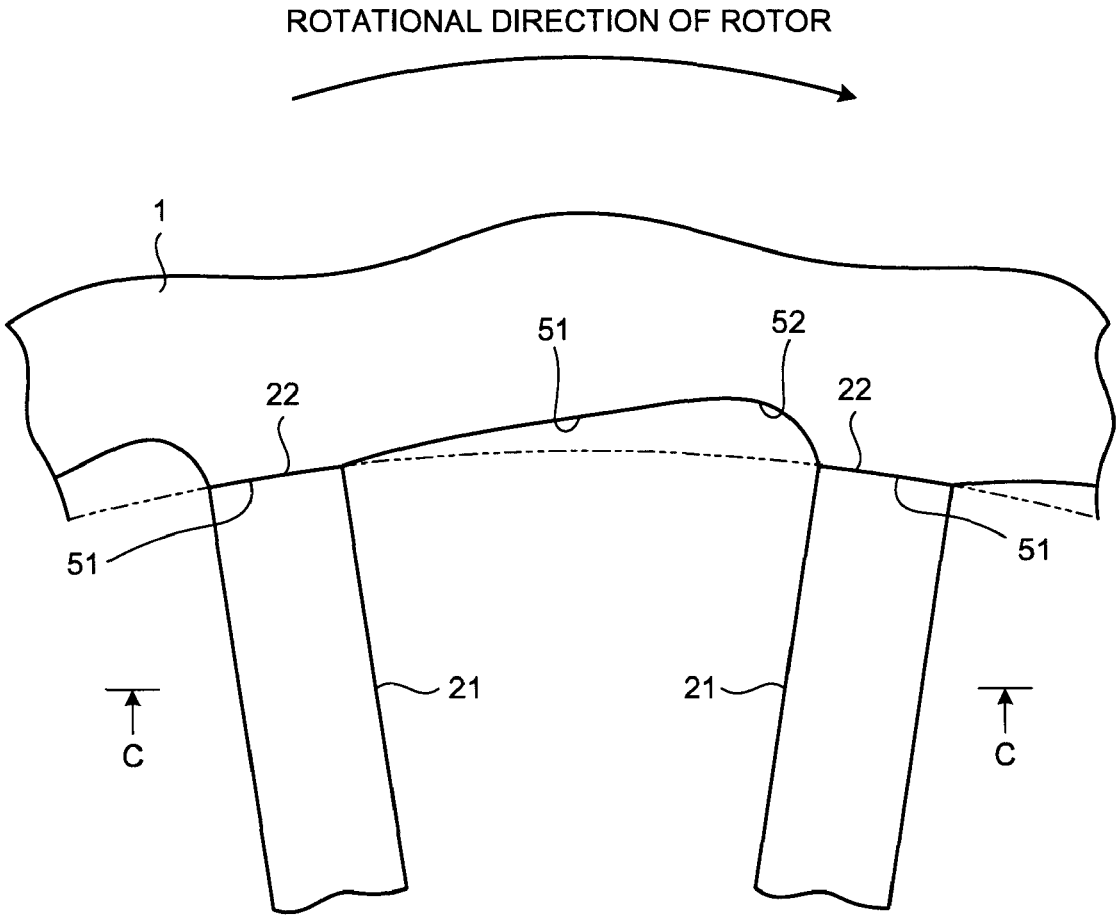
FIG. 13 is a sectional view cut along the line B-B of FIG. 12.
Figure 14:
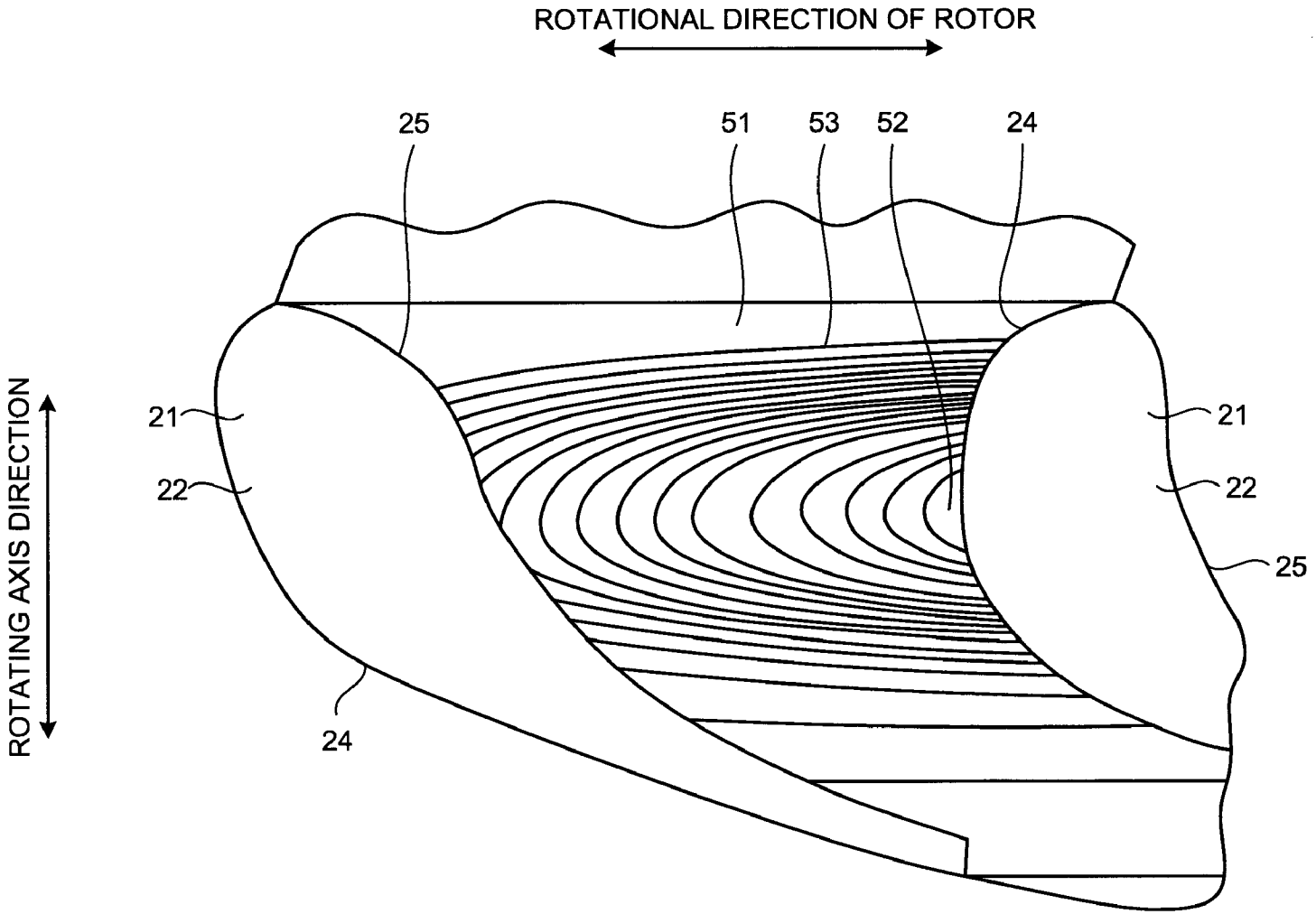
FIG. 14 is a sectional view cut along the line C-C of FIG. 13.

FIG. 13 is a sectional view cut along the line B-B of FIG. 12. FIG. 14 is a sectional view cut along the line C-C of FIG. 13. The end wall 51 that is the wall surface on which the stationary blade 21 is provided in the casing 1 includes a concave portion that is situated between the stationary blades 21 neighboring in the rotational direction of the rotor 5. More specifically, in the end wall 51 situated between the stationary blades 21 neighboring in the rotational direction of the rotor 5, a part of the end wall 51 situated closer to the rotational direction of the rotor 5 than the center of the stationary blades 21 is further concaved compared with a part of the end wall 51 situated closer to the opposite direction side of the rotational direction of the rotor 5 than the center of the stationary blades 21.

The stationary blades 21 neighboring in the rotational direction of the rotor 5 face each other so that the back surface 24 of the stationary blade 21 opposes the ventral surface 25 of the other stationary blade 21. More specifically, the back surface 24 of the stationary blade 21 located closer to the rotational direction of the rotor 5 opposes the ventral surface 25 of the stationary blade 21 located closer to the opposite direction side of the rotational direction of the rotor 5, whereby the neighboring stationary blades 21 face each other. Thus, in the end wall 51 located between the neighboring stationary blades 21, a part of the end wall 51 located on the side of the back surface 24 is further concaved compared with a part of the end wall 51 located on the side of the ventral surface 25, in the back surface 24 and the ventral surface 25 opposing each other. As shown by contour lines 53 in FIG. 14, a depth at a position increases gradually as the position moves from the ventral surface 25 toward the back surface 24. Thus, the end wall 51 is so configured that in the vicinities of the back surface 24 and the ventral surface 25 a deepest section 52 that is the most concaved section is located near the back surface 24 in the back surface 24 and the ventral surface 25 opposing each other.

A blade structure of a gas turbine according to the third embodiment is configured as described above. Functions thereof are described below. While the gas turbine is in operation, the rotor 5 rotates about the rotating axis 6. Thus, the rotor blades 11 connected to the rotor 5 also rotate about the rotating axis 6 in the rotational direction of the rotor 5. Thus, combustion gas flows from the upstream side of each rotor blade 11 and each stationary blade 21 to the downstream side thereof.

When the main flow 32 of the combustion gas flowing from the upstream side to the downstream side flows into the stationary blade, the main flow 32 flows from the side of the ventral surface 25 that is the surface located toward the rotational direction and flows in the direction along the shape of the stationary blade 21 near the leading edge (see FIG. 2). The main flow 32 of the combustion gas flowing into the stationary blade 21 is rectified by the stationary blade 21 and the flow direction thereof is altered thereby. Then, the main flow 32 flows to the rotor blade 11 located downstream of the stationary blade 21.

When the main flow 32 of the combustion gas flows into the stationary blade 21, the main flow 32 flows from the side of the ventral surface 25. In the end wall 51 located between the neighboring stationary blades 21 in the rotational direction of the rotor 5, however, a part of the end wall 51 located on the side of the back surface 24 is further concaved compared with a part of the end wall 51 located on the side of the ventral surface 25, in the back surface 24 and the ventral surface 25 opposing each other between the neighboring stationary blades 21. Thus, near the section in which stationary blade 21 is connected to the end wall 51, space near the side of the back surface 24 is larger than space near the side of the ventral surface 25. Therefore, a pressure difference is reduced between pressures near the ventral surface 25 and near the back surface 24 applied by the combustion gas flowing from the rotor blade 11 to the side of the ventral surface 25 of the stationary blade 21. Therefore, secondary flow caused by decrease of a pressure near the back surface 24 in the section in which stationary blade 21 is connected to the end wall 51 is reduced, thereby reducing secondary flow loss.

Figure 15:
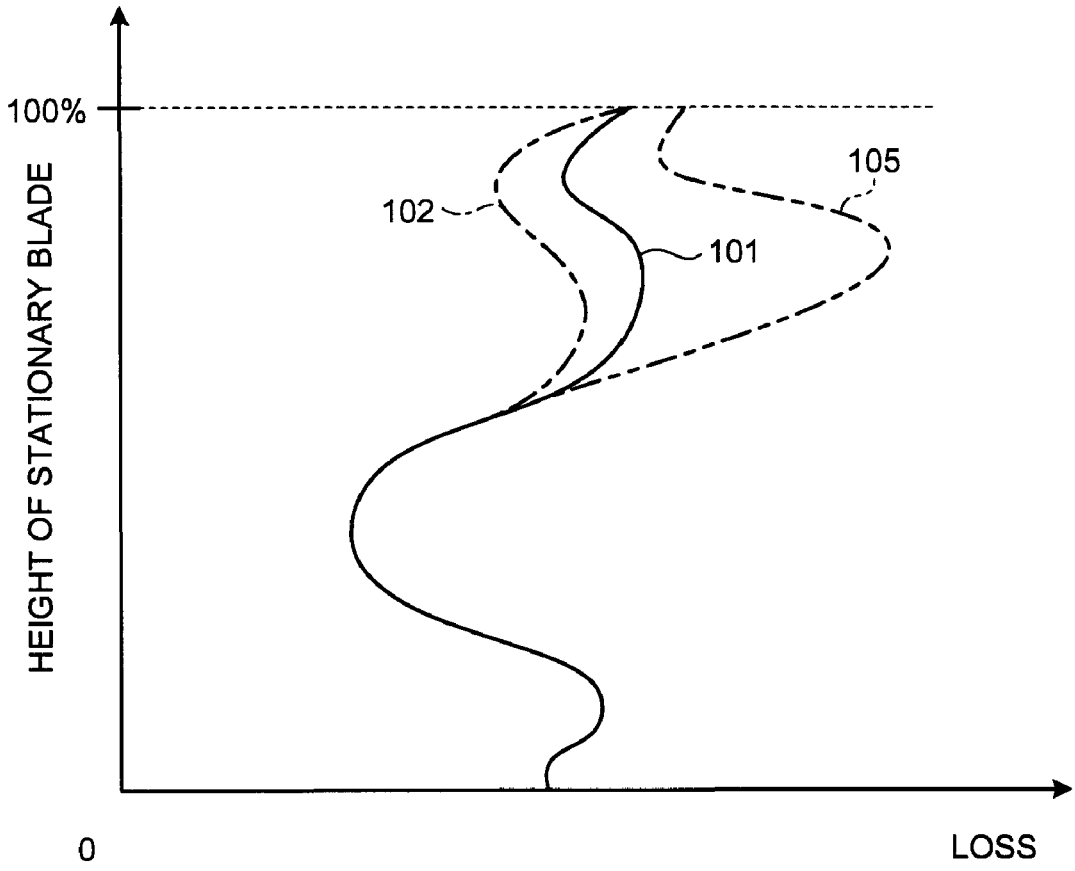
FIG. 15 is a diagram for explaining the distribution of loss at different positions in the heightwise direction of a stationary blade.

FIG. 15 is a diagram for explaining loss distribution at different positions in the heightwise direction of the stationary blade. Thus, by providing a concave portion in the end wall 51 situated between the stationary blades 21 neighboring in the rotational direction of the rotor 5 so that in the back surface 24 and the ventral surface 25 of the stationary blades opposing each other, a part of the end wall 51 situated on the side of the back surface 24 is further concaved compared with a part of the end wall 51 situated on the side of the ventral surface 25, a pressure difference can be reduced between the pressures near the ventral surface 25 and near the back surface 24 in the section in which the stationary blades 21 are connected to the end wall 51. Thus, secondary flow loss of the combustion gas flowing along the stationary blade 21 is reduced. Therefore, loss caused by the combustion gas flowing into the stationary blade 21 is reduced.

More specifically, because the stationary blade 21 is connected to the end wall 51 in the tip portion 22, near the tip portion 22, that is,. nearly 100% in the heightwise direction of the stationary blade 21, secondary flow occurs, and thus, loss increases. Thus, by providing a concave portion in the end wall 51 between the stationary blades 21 neighboring in the rotational direction of the rotor 5 as described above, secondary flow loss can be reduced. Therefore, loss distribution in the heightwise direction of the stationary blade 21 decreases more at nearly 100% in the heightwise direction of the stationary blade 21 compared with the case in which the section located radially outward of the border section 28 is only bent toward the side of the ventral surface 25. Thus, in a loss line for concave-shaped-end-wall 102 that shows loss distribution in the heightwise direction of the stationary blade 21 in a blade structure of a gas turbine according to the third embodiment, the loss at nearly 100% is smaller than the loss line for the bent-shapedstationary-blade 101.

In the blade structure of a gas turbine described above, in the end wall 51 situated between the stationary blades 21 neighboring in the rotational direction of the rotor 5, a part of the end wall 51 situated closer to the rotational direction of the rotor 5 than the center of the stationary blades 21 is further concaved compared with a part of the end wall 51 situated closer to the opposite direction side of the rotational direction of the rotor 5 than the center of the stationary blades 21. More specifically, in the stationary blades 21 neighboring in the rotational direction of the rotor 5, the back surface 24 and the ventral surface 25 oppose each other. When the rotor 5 rotates, the combustion gas flowing from the rotor blade 11 to the stationary blade 21 flows to the ventral surface 25, in the back surface 24 and the ventral surface 25 of the stationary blades 21 opposing each other. Thus, on the side of the back surface 24 and on the side of the ventral surface 25, a pressure on the side of the ventral surface 25 has tendency to be higher than a pressure on the side of the back surface 24. Because of the pressure difference, secondary flow is likely to occur. By providing a concave portion in the end wall 51 as described above, space near the side of the back surface 24 becomes larger. Therefore, secondary flow can be reduced.

Thus, in the back surface 24 and the ventral surface 25 of the stationary blades 21 opposing each other, the back surface 24 is located closer to the rotational direction of the rotor 5 than the center of the stationary blades 21, and in the back surface 24 and the ventral surface 25 of the stationary blades 21 opposing each other, the ventral surface 25 is located closer to the opposite direction side of the rotational direction of the rotor 5 with respect to the center thereof. Therefore, by providing a concave portion in the end wall 51 so that a part of the end wall 51 located closer to the rotational direction of the rotor 5 than the center of the stationary blades 21 is further concaved compared with a part of the end wall 51 located closer to the opposite direction side of the rotational direction of the rotor 5 than the center thereof, space near the back surface 24 becomes larger. Thus, by providing a concave portion in the end wall 51 and thus, by providing larger space near the side of the back surface 24, a pressure difference can be reduced between the side of the back surface 24 and the side of the ventral surface 25. Even if the leakage flow 33 of the combustion gas from the tip clearance 30 flows into the stationary blade 21 near the tip portion 22, secondary flow caused by the pressure difference can be reduced because the pressure difference between the stationary blade 21 near the back surface 24 and the stationary blade 21 near the ventral surface 25 is reduced. As a result, reduction of secondary flow loss and improvement of turbine efficiency can be further ensured.

Figure 16:
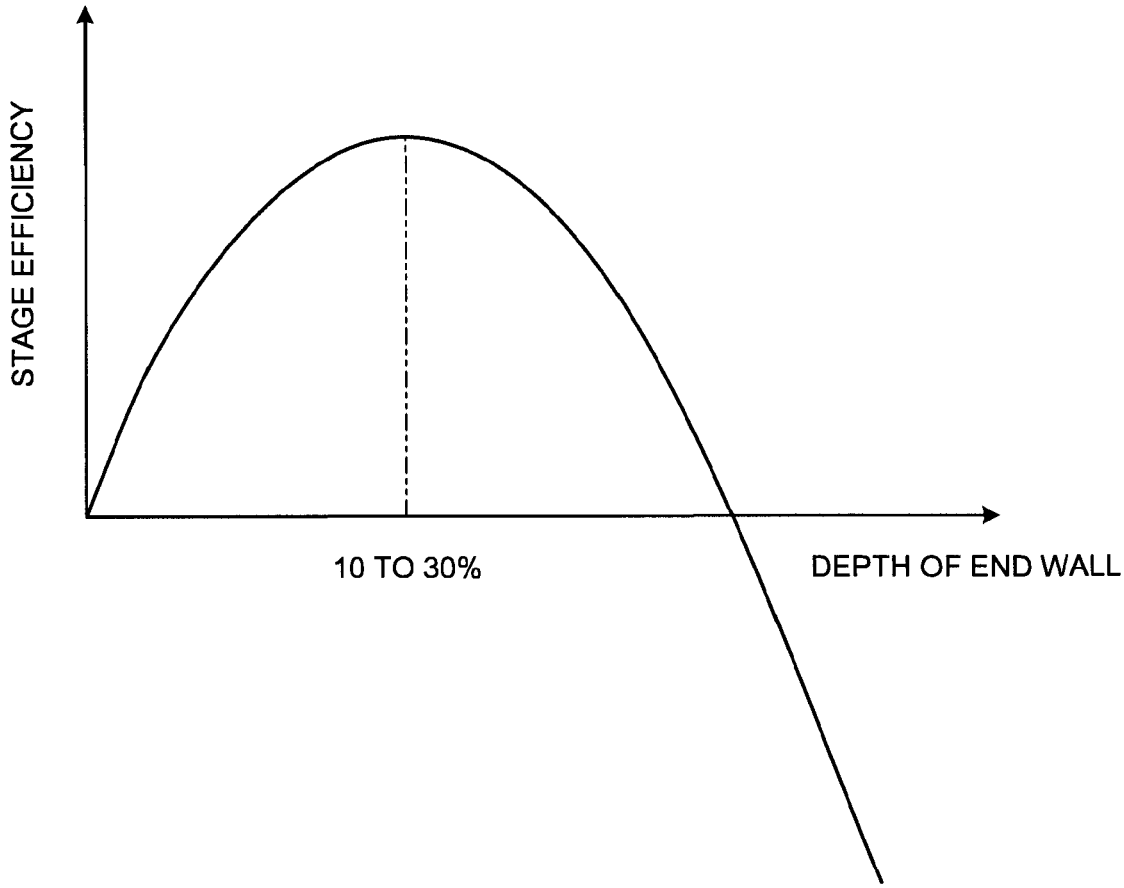
FIG. 16 is a diagram for explaining the relationship between an end wall depth and stage efficiency.
Figure 17:
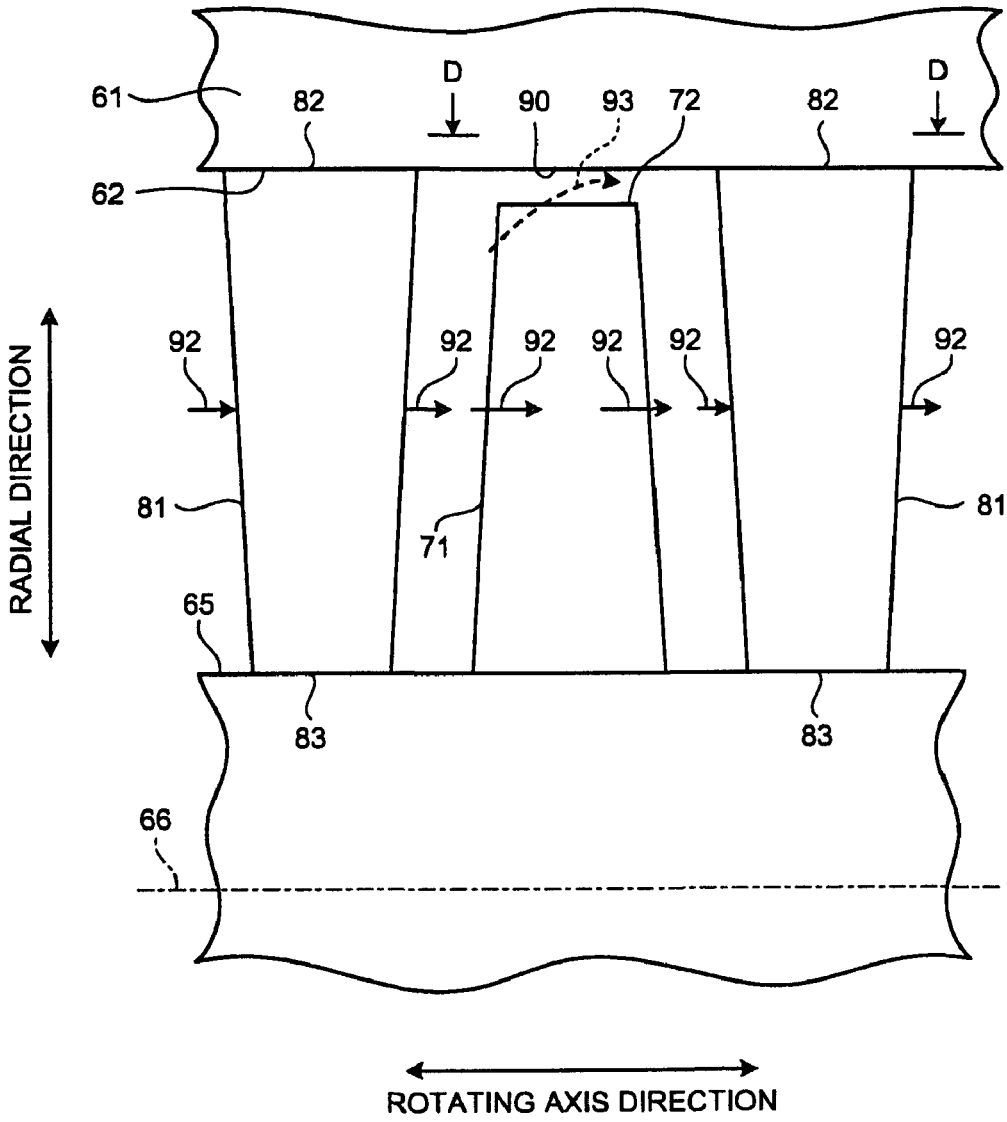
FIG.17 PRIOR ART
FIG. 17 is a schematic for explaining a rotor blade and a stationary blade showing a blade structure of a conventional gas turbine.
Figure 18:
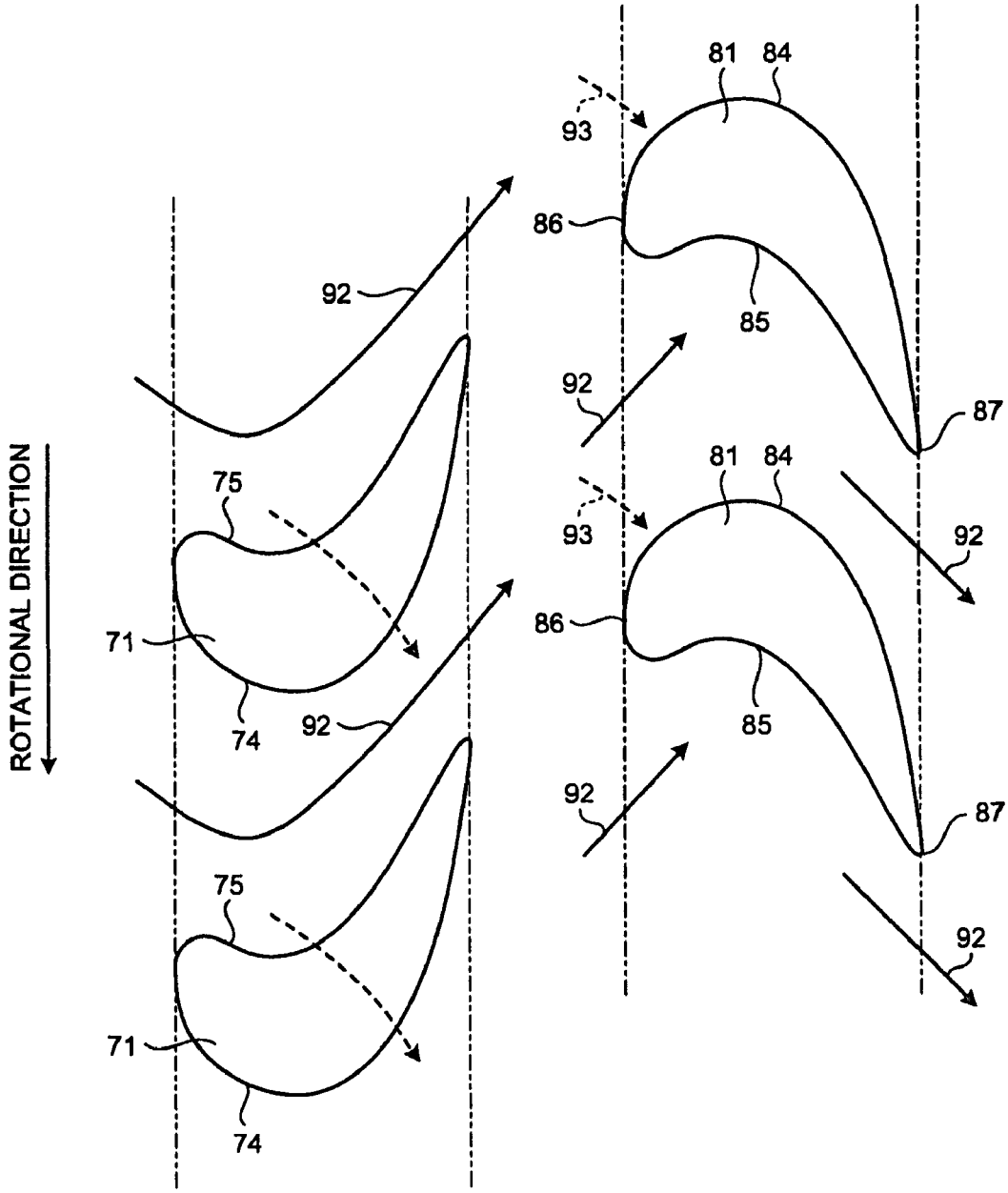
FIG.18 PRIOR ART
FIG. 18 is a sectional view cut along the line D-D of FIG. 17.
Figure 19:
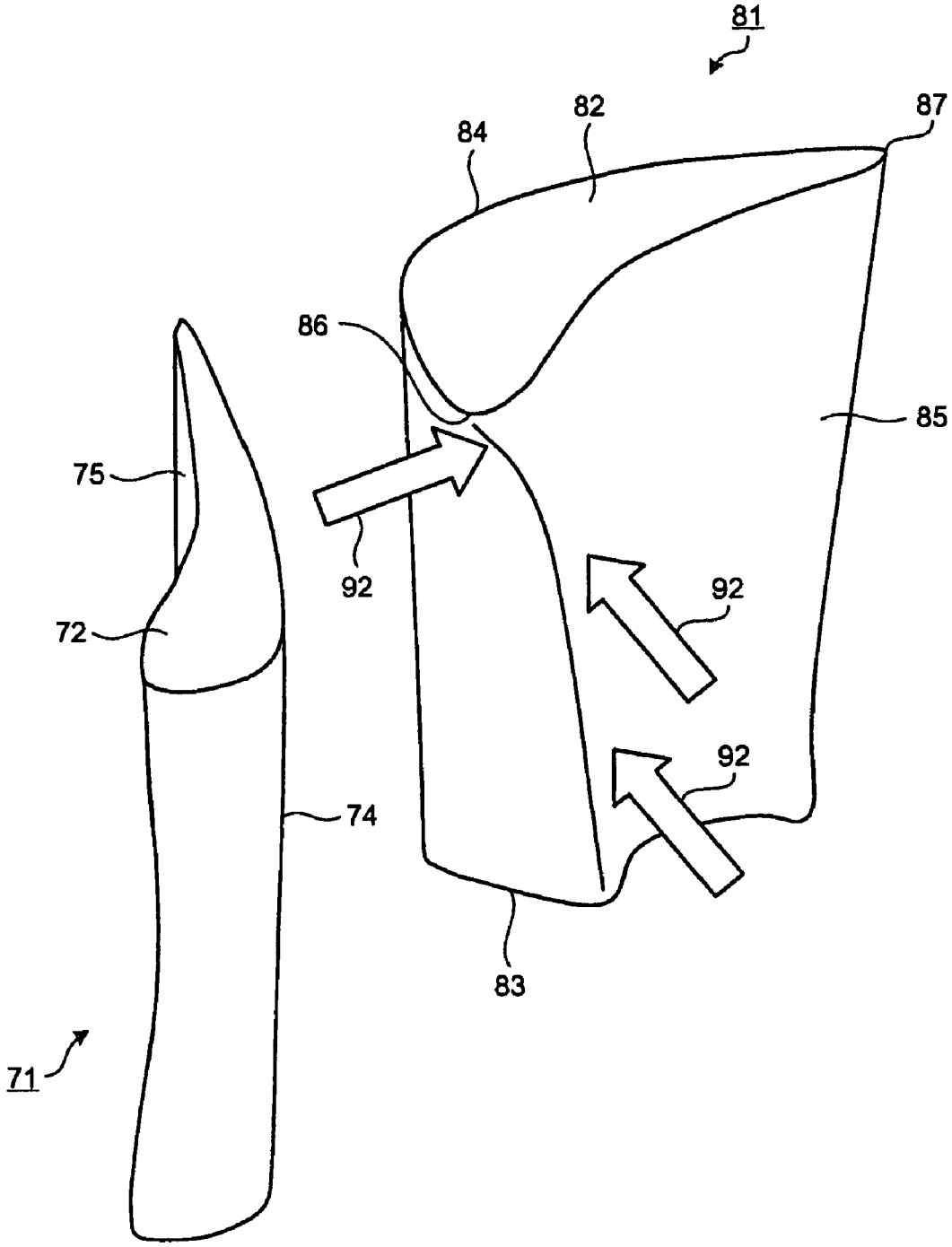
FIG.19 PRIOR ART
FIG. 19 is a perspective view of the rotor blade and the stationary blade shown in FIG. 18.
Figure 20:
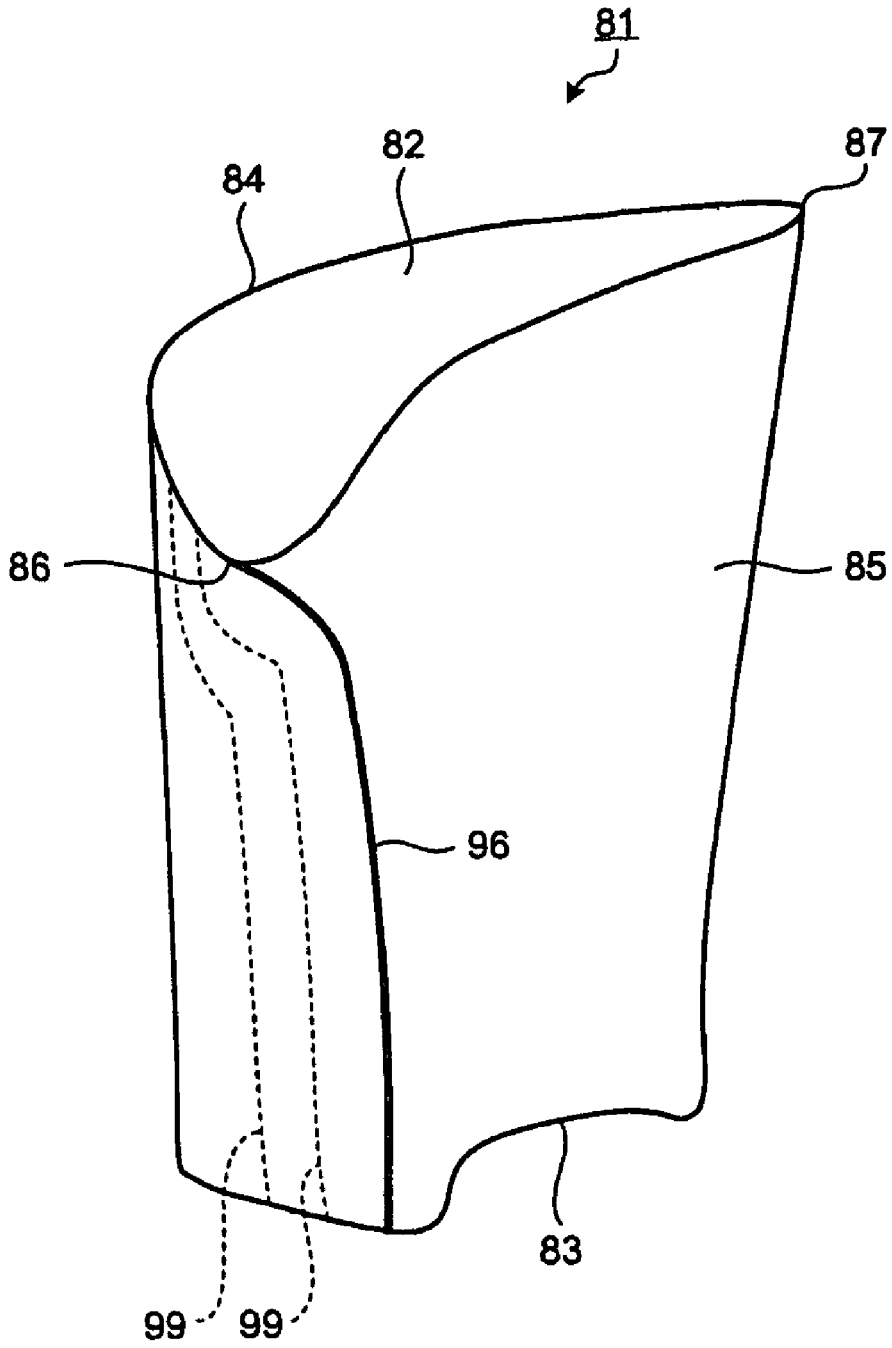
FIG.20 PRIOR ART
FIG. 20 is a schematic for explaining the stationary blade shown in FIG. 17 when gas flows into the stationary blade.
Figure 21:
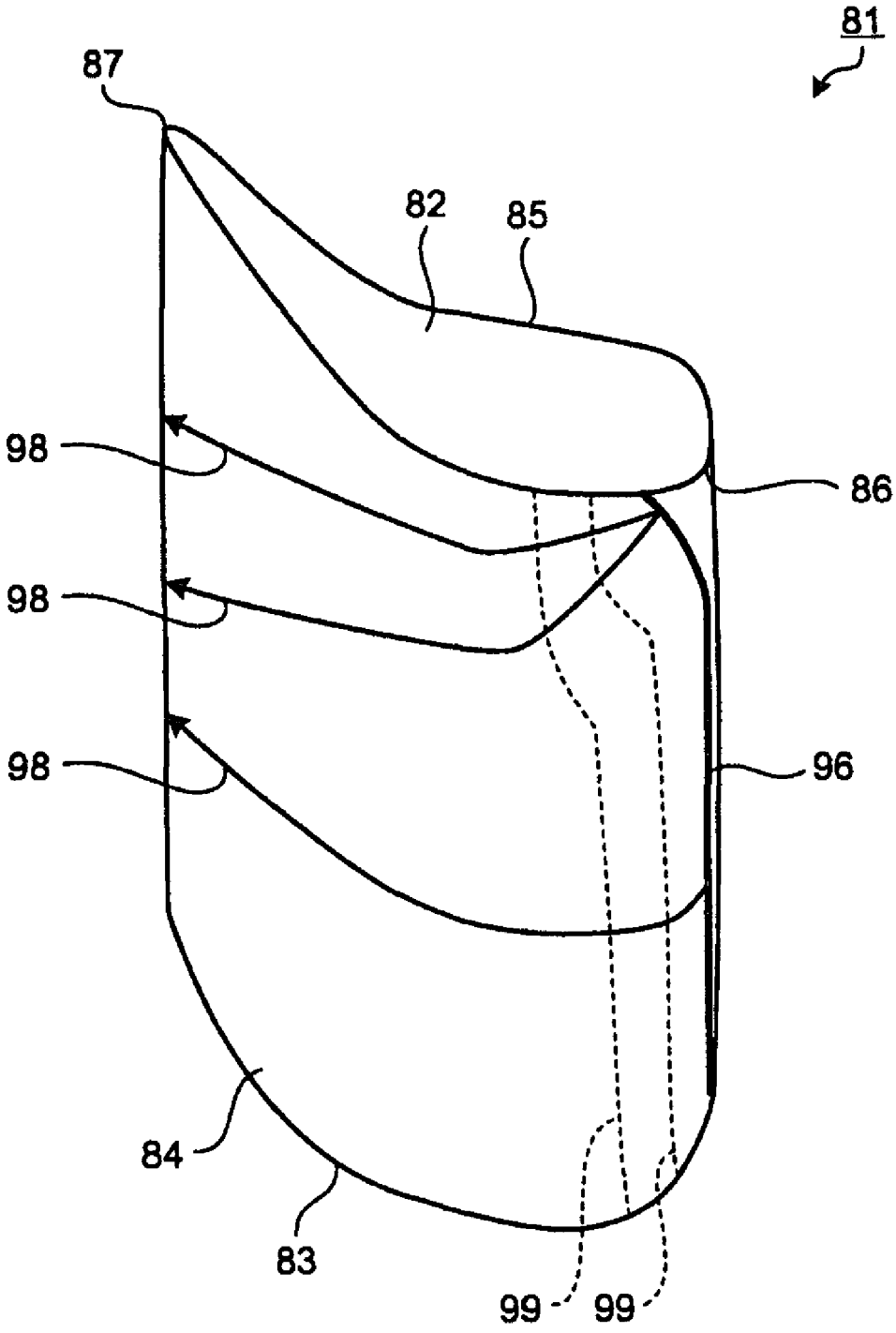
FIG.21 PRIOR ART
FIG. 21 is a schematic for explaining the stationary blade shown in FIG. 17 when gas flows into the stationary blade.

A depth of the end wall 51 between the stationary blades 21 neighboring in the rotational direction of the rotor 5, that is a depth of the deepest section 52, is preferably 10 to 30% of an axial chord, that is, a width of the stationary blade 21 in the rotating axis direction. FIG. 16 is a diagram for explaining relationship between an end wall depth and stage efficiency. As shown in FIG. 16, stage efficiency, that is, efficiency of a stage in which the end wall 51 between the stationary blades 21 neighboring in the rotational direction of the rotor 5 is provided with a concave portion is the highest when a depth of the end wall 51 is concaved by a range of 10 to 30% of the axial chord. As a depth of the end wall 51 is more deviated from the range, stage efficiency becomes lower. Therefore, a depth of the end wall 51 located between the stationary blades 21 neighboring in the rotational direction of the rotor 5 is preferably in a range of 10 to 30% of the axial chord.

In a blade structure of a gas turbine according to the first embodiment, the section of the stationary blade 21 near the tip portion 22 is bent in the rotational direction of the rotor 5. In a blade structure of a gas turbine according to the second embodiment, an axial chord near the tip portion 22 of the stationary blade 41 is reduced. These features can be combined. More specifically, the stationary blade 21 can be bent so that the section located radially outward of the border section 28 is shifted in the rotational direction of the rotor 5 and a width thereof in the rotating axis direction can be reduced so that the width is smaller than the width of the section located radially inward of the border section 28. Thus, reduction of fluctuation of pressure distribution in the heightwise direction of the stationary blade 21 of the combustion gas flowing into the stationary blade 21 can be further ensured, and secondary flow loss can be reduced. Therefore, improvement of turbine efficiency can be further ensured.

In a blade structure of a gas turbine according to the third embodiment, the shape of the stationary blade 21 is identical to the shape of the stationary blade 21 in a blade structure of a gas turbine according to the first embodiment. The shape of the stationary blade 21 may be identical to the shape of the stationary blade 41 in a blade structure of a gas turbine according to the second embodiment or to the shape of combination thereof. Regardless of the shape of the stationary blade 21, the end wall of the casing 1 can be concaved as in a blade structure of a gas turbine according to the third embodiment. Then, a pressure difference between the stationary blades 21 neighboring in the rotational direction of the rotor 5 can be reduced. Thus, secondary flow can be reduced caused by high pressure near the section in which the stationary blades 21 and the end wall 51 are connected to each other. As a result, secondary flow loss can be reduced. Moreover, improvement of turbine efficiency can be further ensured.

Industrial Applicability

As described above, a blade structure of a gas turbine according to the present invention is useful in a case in which stationary blades and rotor blades are used, in particular, in a case in which a tip clearance is provided between the rotor blades and the casing.

The invention claimed is:

1. A blade structure of a gas turbine comprising stationary blades that are arranged annularly in a casing and rotor blades that are arranged annularly on a rotor that is rotatable about an axis of rotation, the stationary blades and the rotor blades being alternately arranged to form a plurality of stages in a direction of the axis of rotation, and a gap being provided between outer edge portions of the rotor blades and the casing, wherein assuming that a height of each of the stationary blades in a radial direction of the rotor is 100%, each of the stationary blades located downstream of the rotor blade, between which and the casing the gap is provided, includes a border section at a position of 80% of the height of the stationary blade outward in the radial direction from an inner edge portion of the stationary blade, and at least a part of a section located outward of the border section in the radial direction is bent towards a rotational direction of the rotor so that a stagnation line, that is a boundary between a combustion gas flowing into a side of a back surface and a combustion gas flowing into a side of a ventral surface, in the section located radially outward of the border section is aligned in a circumferential direction around the axis of rotation with the stagnation line in a section located radially inward of the border section.

2. The blade structure of a gas turbine according to claim 1, wherein a width of each of the stationary blades in a part of the section located outward of the border section in the radial direction is smaller than a width of a section located inward of the border section in the radial direction.

* * * * *